US012203343B2

(12) United States Patent
Falk et al.

(10) Patent No.: US 12,203,343 B2
(45) Date of Patent: Jan. 21, 2025

(54) WELLBORE MILLING AND CLEANOUT SYSTEM AND METHODS OF USE

(71) Applicant: Source Rock Energy Partners Inc., Calgary (CA)

(72) Inventors: Kelvin Falk, Calgary (CA); Brandon Yorgason, Rockyford (CA); Nick Thauberger, Estevan (CA); Bob Stinn, Cochrane (CA)

(73) Assignee: Jet Lift Systems Inc., Calgary (CA)

( * ) Notice: Subject to any disclaimer, the term of this patent is extended or adjusted under 35 U.S.C. 154(b) by 12 days.

(21) Appl. No.: 17/619,293

(22) PCT Filed: Jun. 19, 2020

(86) PCT No.: PCT/CA2020/050863
§ 371 (c)(1),
(2) Date: Dec. 15, 2021

(87) PCT Pub. No.: WO2020/252597
PCT Pub. Date: Dec. 24, 2020

(65) Prior Publication Data

US 2022/0298889 A1 Sep. 22, 2022

Related U.S. Application Data

(60) Provisional application No. 62/927,407, filed on Oct. 29, 2019, provisional application No. 62/864,170, filed on Jun. 20, 2019.

(51) Int. Cl.
*E21B 37/08* (2006.01)
*E21B 21/08* (2006.01)

(52) U.S. Cl.
CPC ..... *E21B 37/08* (2013.01); *E21B 21/08* (2013.01)

(58) Field of Classification Search
CPC ..... E21B 37/00; E21B 37/02; E21B 37/04; E21B 37/045; E21B 37/081; E21B 21/002; E21B 21/08
See application file for complete search history.

(56) References Cited

U.S. PATENT DOCUMENTS 4,657,092 A * 4/1987 Franks, Jr. ..... E21B 17/18 175/324
5,033,545 A * 7/1991 Sudol ..... E21B 41/0078 134/167 C (Continued)

FOREIGN PATENT DOCUMENTS

WO 2011/004183 A2 1/2011

OTHER PUBLICATIONS

International Search Report issued for Int. Appl. No. PCT/CA2020/050863 dated Sep. 18, 2020, 12 pp.

*Primary Examiner* — David Carroll
(74) *Attorney, Agent, or Firm* — James A. Sheridan; Sheridan Law, LLC

(57) ABSTRACT

Systems and methodologies are provided for simultaneously milling obstructions from within a subterranean wellbore while pumping the milled obstructions and debris from the wellbore to the surface. The present systems and methodologies are operative in a first milling and/or cleanout mode of operation to both mill the obstructions from the wellbore and then to clean such debris therefrom, a cleanout mode of operation alone, and/or a flushing mode of operation to flush the system and wellbore as desired. The present systems and methods of use may comprise providing at least one sealing assembly for sealingly positioning the system within the annular space of the wellbore, isolated the wellbore therebelow, providing at least one pump assembly configured in reverse circulation for cleaning the wellbore, and providing (Continued)

at least one milling assembly for milling obstructions from within the wellbore.

19 Claims, 18 Drawing Sheets

(56) References Cited

U.S. PATENT DOCUMENTS

| | | | | |
|---|---|---|---|---|
| 6,176,311 | B1 * | 1/2001 | Ryan | E21B 31/06 166/99 |
| 6,250,387 | B1 * | 6/2001 | Carmichael | E21B 21/002 166/229 |
| 6,276,452 | B1 * | 8/2001 | Davis | E21B 41/00 166/99 |
| 2004/0099413 | A1 * | 5/2004 | Arceneaux | E21B 21/00 166/173 |
| 2009/0283330 | A1 | 11/2009 | Lynde et al. | |
| 2010/0288485 | A1 * | 11/2010 | Blair | E21B 29/002 166/99 |
| 2010/0288492 | A1 * | 11/2010 | Blackman | E21B 27/005 166/250.01 |
| 2014/0053874 | A1 * | 2/2014 | Mackenzie | E21B 37/00 134/22.12 |
| 2014/0196953 | A1 * | 7/2014 | Chitwood | E21B 7/068 175/57 |
| 2016/0084077 | A1 * | 3/2016 | Lehr | E21B 21/08 367/83 |
| 2018/0238143 | A1 * | 8/2018 | Falk | E21B 33/127 |
| 2023/0092939 | A1 * | 3/2023 | Iuell | E21B 33/1285 166/374 |

* cited by examiner

WELLBORE MILLING AND CLEANOUT SYSTEM AND METHODS OF USE

CROSS REFERENCE TO RELATED APPLICATION

This application claims benefit of priority to U.S. Provisional Patent Application Ser. No. 62/864,170, entitled "PRESSURE BALANCED, WELLBORE MILLING SYSTEM", filed on Jun. 20, 2019, and to U.S. Provisional Patent Application Ser. No. 62/927,407, entitled "PRESSURE BALANCED, WELLBORE MOTOR MILLING SYSTEM", filed Oct. 29, 2019, the entire contents of which are hereby incorporated by reference in their entirety.

FIELD

Embodiments herein are generally related to systems and methodologies for milling an obstruction from within a subterranean wellbore and/or cleaning debris and milled obstructions from the wellbore. More specifically, systems are provided for simultaneously milling obstructions from a wellbore and pumping the milled obstructions from the wellbore.

BACKGROUND

Oil and gas companies drill vertical or horizontal wells into hydrocarbon bearing formations in order to gain extended wellbore access to these formations and to allow the hydrocarbons to flow to the wellbore in order to produce them to surface. Problems arise, however, when the wellbore becomes plugged with solidified sand, filter cake, built up scale, or other hard particulate solids, or when downhole equipment becomes lodged or needs to be milled from the depths of the wellbore (e.g. downhole millable plugs, frac sleeves, etc.). In some cases, temporary equipment such as bridge plugs are intentionally installed and left in the wellbore on the understanding that they will later need to be removed through a downhole milling operation.

Currents methods of cleaning a wellbore typically involve running in with some form of tubing workstring and pumping fluids from the surface to the area to be cleaned downhole, with the fluids and the entrained debris circulating back to the surface. If the target material is hard, or if an operation is required to remove downhole equipment, the pumping fluid may also be used to power a downhole milling motor and bit, where the pumping fluid also acts to wash cuttings out of the mill cutting area, continuing to move the debris out of the wellbore and returning the fluids all the way back to the surface. In order for such know methods to be successful, the bottom of the hole circulating pressure must be high enough to support circulation but low enough to prevent leak off into the formation. Moreover, the fluid velocity and rheological properties must support solids suspension and transport.

Predictably, milling challenges are encountered when the bottomhole pressure of the well is insufficient to support fluid returns to the surface. Where fluids pumped into the wellbore exit the work string at excessive pressures, the fluids may and will enter the formation instead of returning to the surface. Operators can attempt to overcome these conditions by pumping fast enough to overcome the loss rate to the formation, however, losses can often be too high for such methods to succeed. Unfortunately, fluids losses to the formation can potentially risk permanent damage to the formation, reducing future hydrocarbon recovery and requiring long clean-up time (with the use of artificial lift systems).

Other methods of reducing circulation pressures while milling often involve the use of coiled tubing, a downhole motor and mill, and pumping liquid and a gas phase—such as nitrogen. The nitrogen reduces the return flow hydrostatics. One issue with this method is the high cost of operation, while another issue is the tendency for the motor to stall due to the compressibility of the gas phase. Stalls can be difficult to overcome, and not only delay the operation by can cause motor overspeed when the stall weight is reduced. Finally, with gas phase making up part of the supplied flow rate to drive the motor, hole cleaning performance is greatly reduced, as the gas phase does not significantly contribute to solids transport in the horizontal section of the well.

Attempts to improve wellbore cleanout processes where the bottomhole circulating pressure is a concern have involved the use of jet pumps, the pumps being used to draw wellbore fluids into a closed-circuit hydraulic stream for return to the surface. Known pumping procedures are generally successful in wells having very low bottomhole pressures, where the wellbore fluids cannot be transported easily to the surface. Known pumping system are typically designed such that well fluids and solids enter the jet pump at the bottomhole pressure, with the pumps serving to increase fluid pressures while the fluids are suctioned up the work string. In this regard, pumping systems can be used to facilitate circulation where the circulation no longer depends on bottom hole pressure alone.

There is a need for improved wellbore cleaning systems and methods of use, such systems operative to allow for cleaning operations to be conducted while also maintaining a balanced, near-balanced, or underbalanced condition in the wellbore.

SUMMARY

According to embodiments, an improved system and methods of use for simultaneously milling an obstruction from within the annular space of a subterranean wellbore and cleaning milled debris from the wellbore is provided, whereby the system is configured to maintain a balanced, near-balanced, or underbalanced bottom hole condition.

Broadly, the present system may comprise a jet pump assembly, a pressure isolation tool comprised of a fluid flow bypass assembly and a sealing assembly for sealingly engaging the system within the annular space of the wellbore, a tubing 'stinger' length extending downhole from the system, and a milling assembly operably connected thereto. In some embodiments, the present system may comprise at least one fluid flow diverter sub, providing an alternative fluid flow path through the system. In other embodiments, the present system may comprise at least one telescopic pressure sub, operative to efficiently and effectively position the milling motor and mill bit as its advances through the obstruction.

In some embodiments, the system comprises at least one tubing string for deploying the system within the annular space of the wellbore, the tubing string rotatable about its longitudinal axis and operative to rotate the entire system. When rotated, the system may concurrently mill and suction the milled obstruction debris from the wellbore. When stationary, the system may only to suction the debris from the wellbore without milling.

In some embodiments, the system comprises at least one sealing assembly for releasably sealing and anchoring the system within the annular space of the wellbore and isolating the wellbore therebelow. The system may be positioned and repositioned within the wellbore, ensuring that the system, and its milling assembly, land at or near the obstruction the wellbore.

In some embodiments, the system comprises at least one pump assembly, operatively connected to the tubing string and in fluid communication therewith, for pumping debris and wellbore fluids from the annular space of the wellbore into the system and to the surface as return fluids. The at least one pumping assembly may be configured for reverse circulation, receiving at least a first portion of a fluid stream injected from the surface into the annular space of the wellbore as a power fluid stream for driving the at least one pump assembly.

In some embodiments, the system comprises at least one fluid bypass assembly forming a discrete fluid pathway through the system, for diverting fluids through the system into the isolated portion of the wellbore therebelow. The at least one fluid bypass assembly may be configured to receive at least a second portion the injected fluid stream from the surface as a cleaning fluid stream, and jetting the cleaning fluid stream downhole flushing debris and wellbore fluids into the system for return to the surface. In some embodiments, the system may comprise a flow diverter sub operably connected to the outlet end of the fluid bypass assembly, the diverter sub providing an alternative, yet still discrete, flow path through the system.

In some embodiments, the system comprises at least one milling assembly, operatively connected to the tubing string and in fluid communication therewith, for milling the obstruction when the system is rotated. In some embodiments, the present system may further comprise at least one telescopic pressure sub, operably connected to the milling assembly, for optimizing positioning of the milling assembly as it advances through the obstruction.

In some embodiments, the system may comprise one or more filters or screen elements for capturing larger debris particulates, preventing the larger debris from entering and clogging the system.

According to embodiments, methods of concurrent milling and cleaning an obstruction from the annular space of a subterranean wellbore are provided, the methods comprising the use of a system sealingly positioned within the annular space of the wellbore and isolating a target portion of the wellbore therebelow. In some embodiments, the methods may comprise deploying the system with, and operably connected to, a tubing string, the tubing string being rotatable about its longitudinal axis for rotating the system. In some embodiments, the methods may comprise injecting a pressurized fluid stream from the surface into the annular space of the wellbore uphole of the system, wherein at least a first portion of the injected fluids enters the system as a power fluid stream to drive at least one pump assembly for pumping milled obstruction debris from the annular space of the wellbore into the system, and wherein at least a second portion of the injected fluids is diverted through a discrete flow path as a cleaning fluid stream to the isolated annular space of the wellbore below the system. In some embodiments, the methods may comprise rotating the tubing string, which in turn rotates the system, to drive at least one milling assembly, for milling the obstruction within the annular space of the wellbore, therein simultaneously milling the obstruction, cleaning the annular space of the wellbore, and pumping milled obstruction debris from the annular space into the system.

In some embodiments, the methods may comprise ceasing rotation of the system and injecting the pressurized fluid stream from the surface into the annular space as a power fluid stream to only pump the debris and wellbore fluids from the annular space of the wellbore into the system. In other embodiments, the methods may comprise ceasing rotation of the system and injecting a pressurized fluid stream from the surface into the central bore of the tubing string to flush debris and cuttings from the milling assembly.

BRIEF DESCRIPTION OF THE DRAWINGS

Embodiments of the present system will now be described by way of an example embodiment with reference to the accompanying simplified, diagrammatic, not-to-scale drawings. Any dimensions not provided in the drawings are provided only for illustrative purposes, and do not limit the invention as defined by the claims.

In the drawings.

DETAILED DESCRIPTION OF EMBODIMENTS

Reference will now be made to the accompanying drawings, which assist in illustrating the various pertinent features of the present system. The following description is presented for purposes of illustration and description and is not intended to limit the inventions to the forms disclosed herein. Consequently, variations and modifications commensurate with the following teachings, and skill and knowledge of the relevant art, are within the scope of the presented embodiments. The embodiments described herein are further intended to explain the best modes known of practicing the inventions and to enable others skilled in the art to utilize the inventions in such, or other embodiments and with various modifications required by the particular application(s) or use(s) of the presented inventions.

Herein, the words "lower", "upper", "above", "below", reference to direction, and variation thereof denote positions of objections relative to the wellbore opening at surface, rather than to directions by gravity. For example, "lower" should be interpreted to mean further downhole away from the wellbore opening and "upper" should mean further uphole towards the wellbore opening.

According to embodiments, systems and methods for concurrently milling an obstruction and cleaning debris from the annular space of a subterranean wellbore are provided. The present system may be sealingly positioned within the wellbore, and may be interchangeably operated between milling and/or cleaning modes of operation and, where desired, a flushing mode of operation, while advantageously maintaining a balanced near-balanced, or underbalanced bottom hole condition. The present system will now be described in more detail with reference to FIGS. 1-14.

Figure 1:
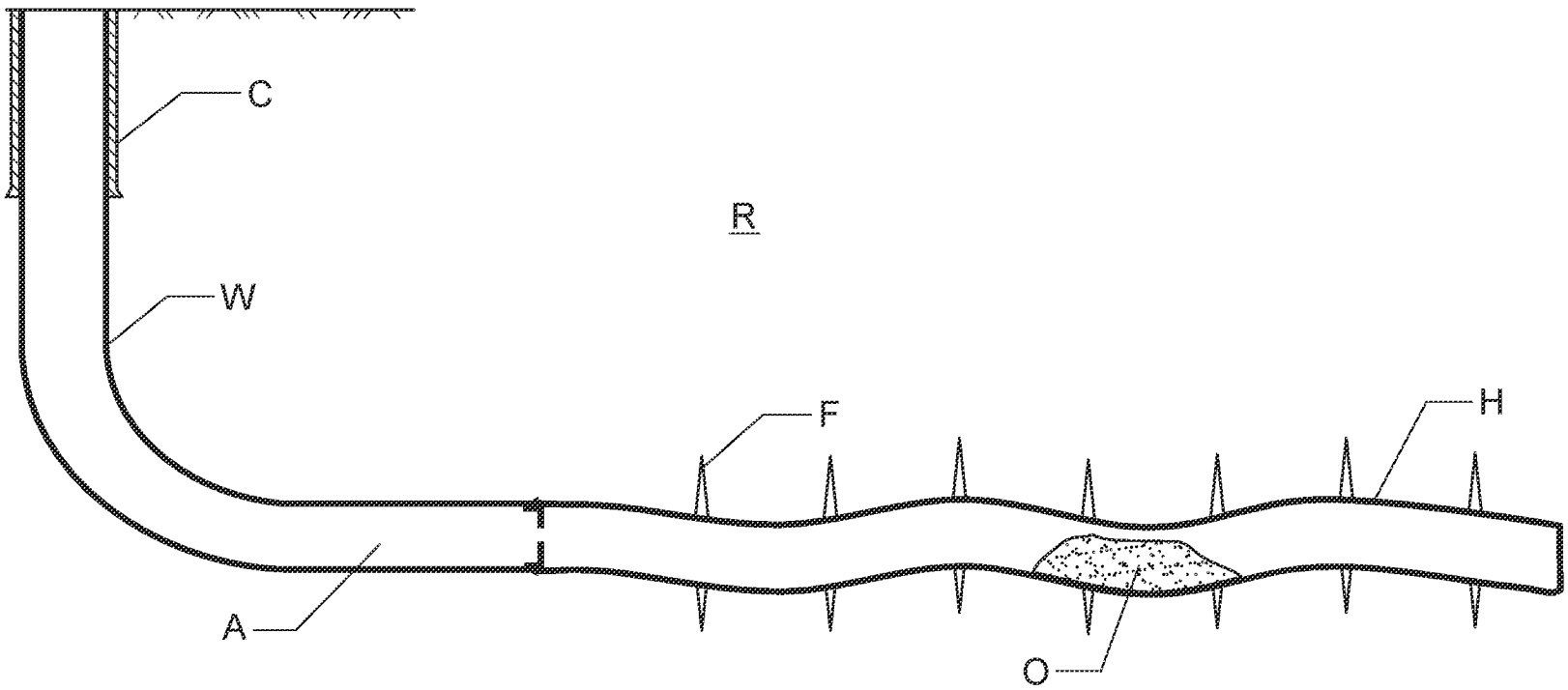
FIG. 1 depicts a schematic representation of a typical oil and/or gas well having a horizontal section.

Having regard to FIG. 1, a sample horizontal well W completed with a well casing C and having a deviated or horizontal section H, at least a portion of which extends through a subterranean reservoir R. The horizontal section H may be open hole or lined with a liner, casing or other type of well pipe that is known in the art. There may be a single casing string (e.g. monobore) all the way to the end or 'toe' section of the wellbore, or casing with a liner in the horizontal section H. The diameter of the wellbore W may be consistent along its entire length, or it may vary (e.g. at the casing-liner overlap). As would be understood, the wellbore W may be open hole, or comprise a plurality of perforations or frac ports F intermittently spaced along the horizontal section H to provide fluid communication with the reservoir R. For illustrative purposes, the horizontal section H is shown to have one or more millable obstruction(s) O, with such obstructions O fully or partially blocking the wellbore (e.g. the obstruction(s) may be impacting production of fluids therefrom).

Figure 2:
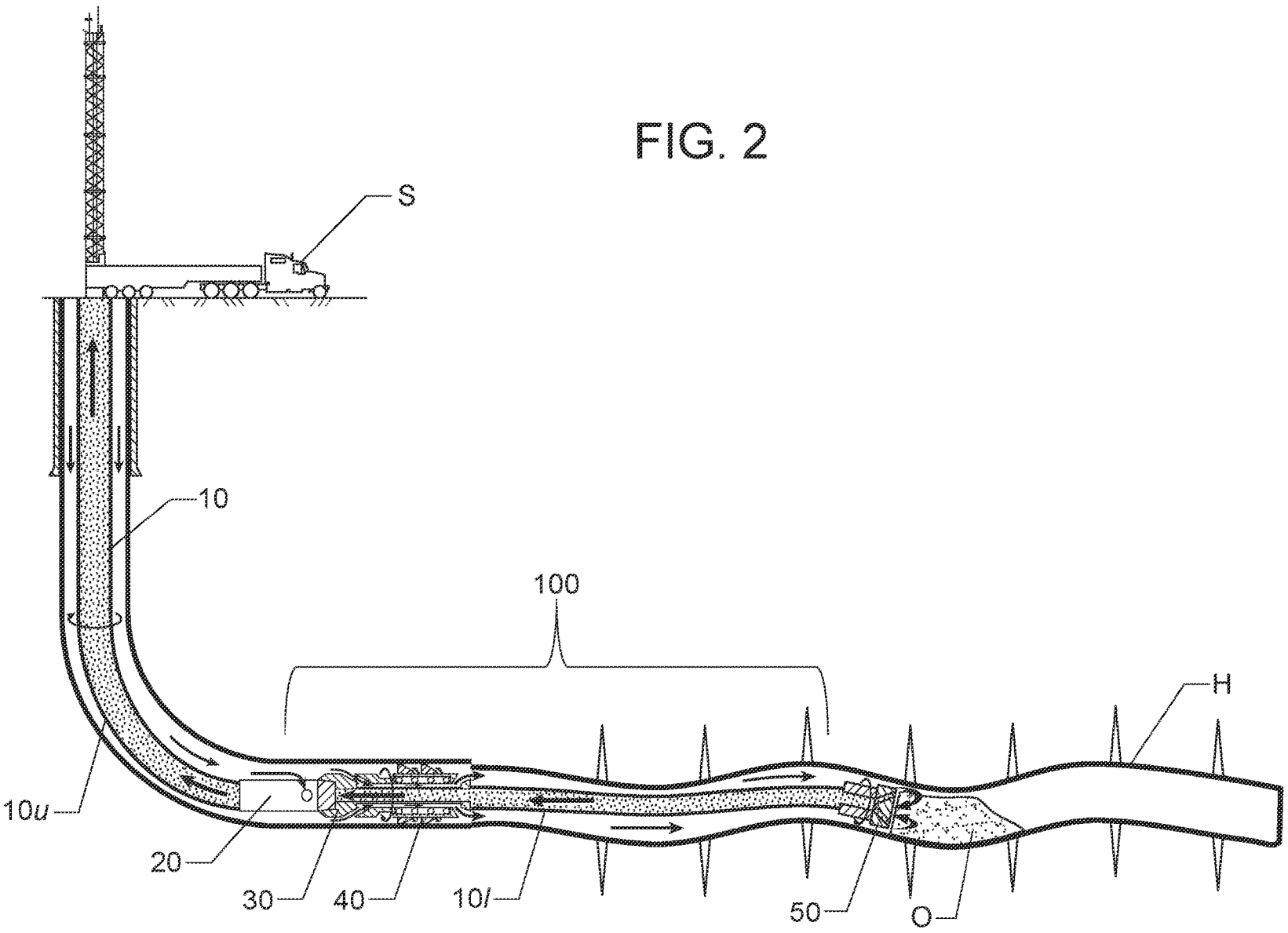
FIG. 2 depicts a schematic representation of the present system deployed within the horizontal wellbore shown in FIG. 1, according to embodiments.

FIG. 2 depicts the same sample wellbore W shown in FIG. 1 with the present system 100 positioned therein. The system 100 may be deployed within the wellbore by a conventional oilfield service rig S and it may be sealingly positioned at, near, or within the horizontal section H.

Although the present disclosure describes the present system 100 being deployed at, near, or within the horizontal section H of the wellbore W, a person of skill in the art will know and understand that the present system and methods can be deployed in one or more other sections of the wellbore. In some embodiments, the present system 100 may be deployed or 'run in hole' until the system 100 reaches an obstruction O, or to any other such location as may be desired (e.g. where hole cleaning may be required). As will be described, once in position, the present system 100 may sealingly engage the wellbore annulus A, thereby closing off the annular space at its lower end (i.e. downhole from the system 100, and operated in either a first milling mode of operation and/or a second cleanout mode of operation.

Herein, service rig S used to deploy the system 100 may encompass, without limitation, a tubing conveyance assembly (mast or other), one or more fluid pumps and surface tanks, fluids, a power swivel, and other tubing rotation drive system. The present system 100 may be deployed with or 'run in hole' via a workstring 10, interchangeably referred herein to as a tubing string and/or a workstring, the length of which being operatively increased or decreased in order to optimize positioning of the system 100. In some embodiments, the tubing string 10 may be used to raise (travel uphole) and/or lower (travel downhole) the system 100 within the wellbore as obstruction(s) are removed and the wellbore becomes unplugged. In some embodiments, the tubing string 10 may also be rotatable about its axis and thus used to operably rotate the system 100 during milling operations (see rotational arrows; FIG. 2). Advantageously, the present system 100 may be positioned at a sufficient depth to achieve optimal use, that is—to achieve optimal fluid differentials above and below the system 100 (e.g. depending upon changes in the bottom hole pressure and/or system capacity), minimizing fluid losses and impact upon the reservoir R, while achieving optimal milling of obstructions and cleaning out of debris from within the wellbore. To this end, the overall length of the present system 100 may be altered to suit each specific application.

Figure 13:
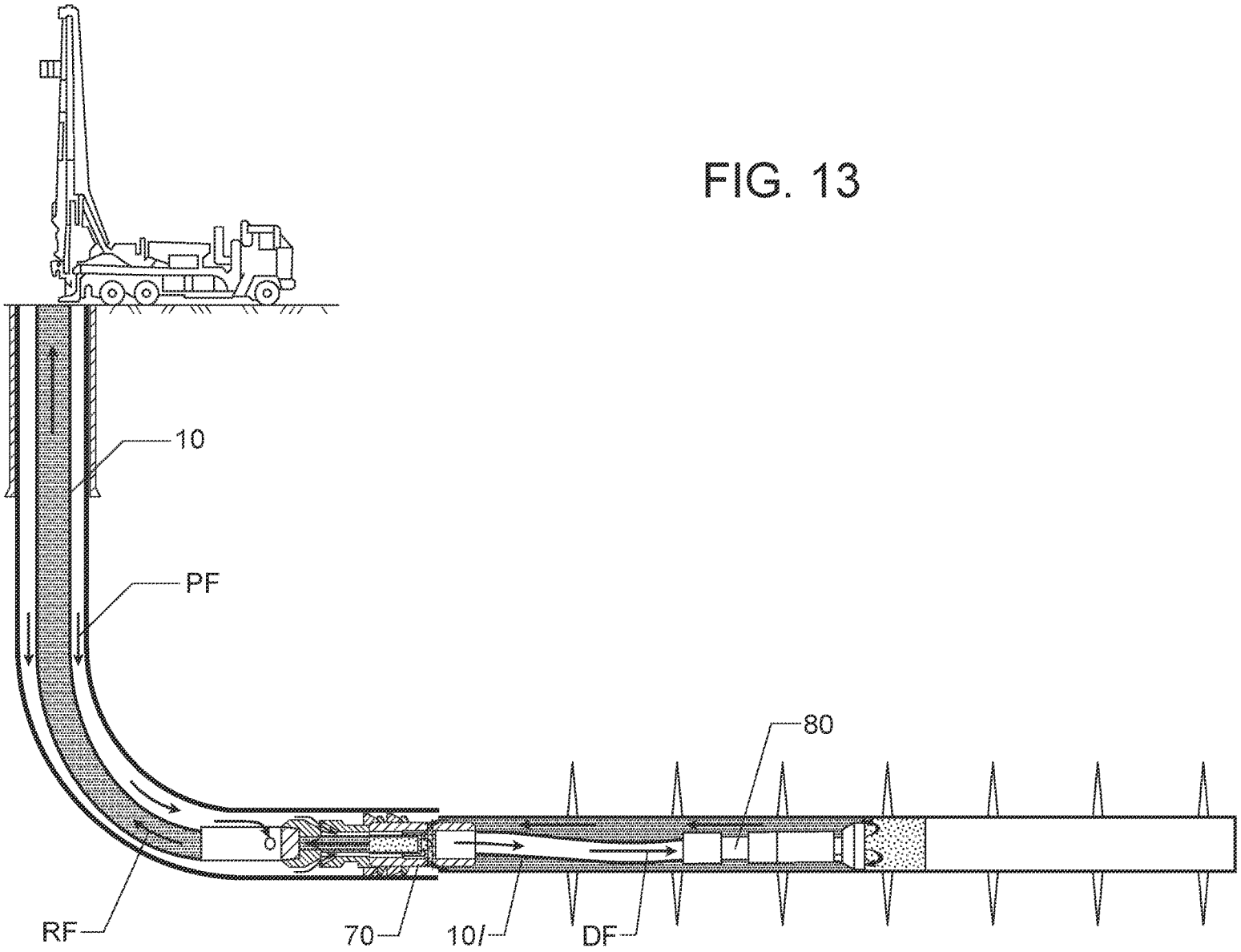
FIG. 13 depicts a schematic representation of the alternative embodiment shown in FIG. 6, the system having the telescopic pressure sub deployed (or extended) within the wellbore, according to embodiments.

According to embodiments, as will be described in more detail, the present system 100 may comprise at least one a jet pump assembly 20, a pressure isolation tool comprised of a fluid flow bypass assembly 30 and a sealing assembly 40 for sealingly engaging the system 100 within the annular space A, a tubing 'stinger' length 10*l*, and a milling assembly 50. In some embodiments, the present system may optionally include at least one filter or screen (60; FIGS. 3C, 3D, 3E, 10 and 11) for controlling the size of debris being removed from the wellbore W. In other embodiments, the present system 100 may include at least one fluid flow diverter sub 70 (FIGS. 7, 8, 9A, 9B, 10, 12A and 12B), providing an alternative fluid flow path through the system 100. In yet other embodiments, the present system 100 may include at least one telescoping pressure sub 80 positioned within the stinger 10*l*, allowing the milling motor and mill bit to advance further into the obstruction material due to differential pressure force expanding the sub 80 (FIG. 13).

Broadly, as will be described, the present system 100 may generally be operated concurrently in a 'milling mode of operation' and a 'cleanout mode of operation'. In this mode of operation, the system 100 is configured for reverse circulation and is rotated to advance the milling assembly 50 through one or more obstruction(s) O within the subterranean wellbore W (e.g. FIG. 36). Power fluids PF are pumped from the surface down the annular space A of the wellbore W, such power fluids PF operative to drive the jet pump assembly 20, which serves to suction wellbore fluids and milled obstruction debris entrained therein from the wellbore W to the surface. Accordingly, when the system is rotated, the wellbore is cleaned simultaneously to the milling of the obstruction. Where desired, the present system 100 may alternatively be operated only in a 'cleanout mode of operation', where rotation of the system 100 may ceased temporarily and fluids may be pumped through the system 100 to sweep debris and cuttings from the milling assembly 50 (e.g. FIG. 3A). Once the wellbore W has been cleaned, rotation of the system can begin again and the milling mode of operation may continue. Finally, when desired, the system may be operated in a 'flushing mode of operation', where pressurized fluids are pumped from the surface through the system to flush cuttings and debris from the milling assembly.

In any of the foregoing modes of operation, the present system 100 may initially be operably run in hole via tubing string 10, the tubing string 10 being extended until the desired position within the annular space A of the wellbore W is reached. The pressure isolation tool may then be engaged to sealingly anchor the present system 100 within the annular space A of the wellbore W, effectively isolating a lower portion of the wellbore W below the system 100.

Each of the foregoing components of the present system 100 and its modes of operation will now be described in more detail.

Figure 3A:
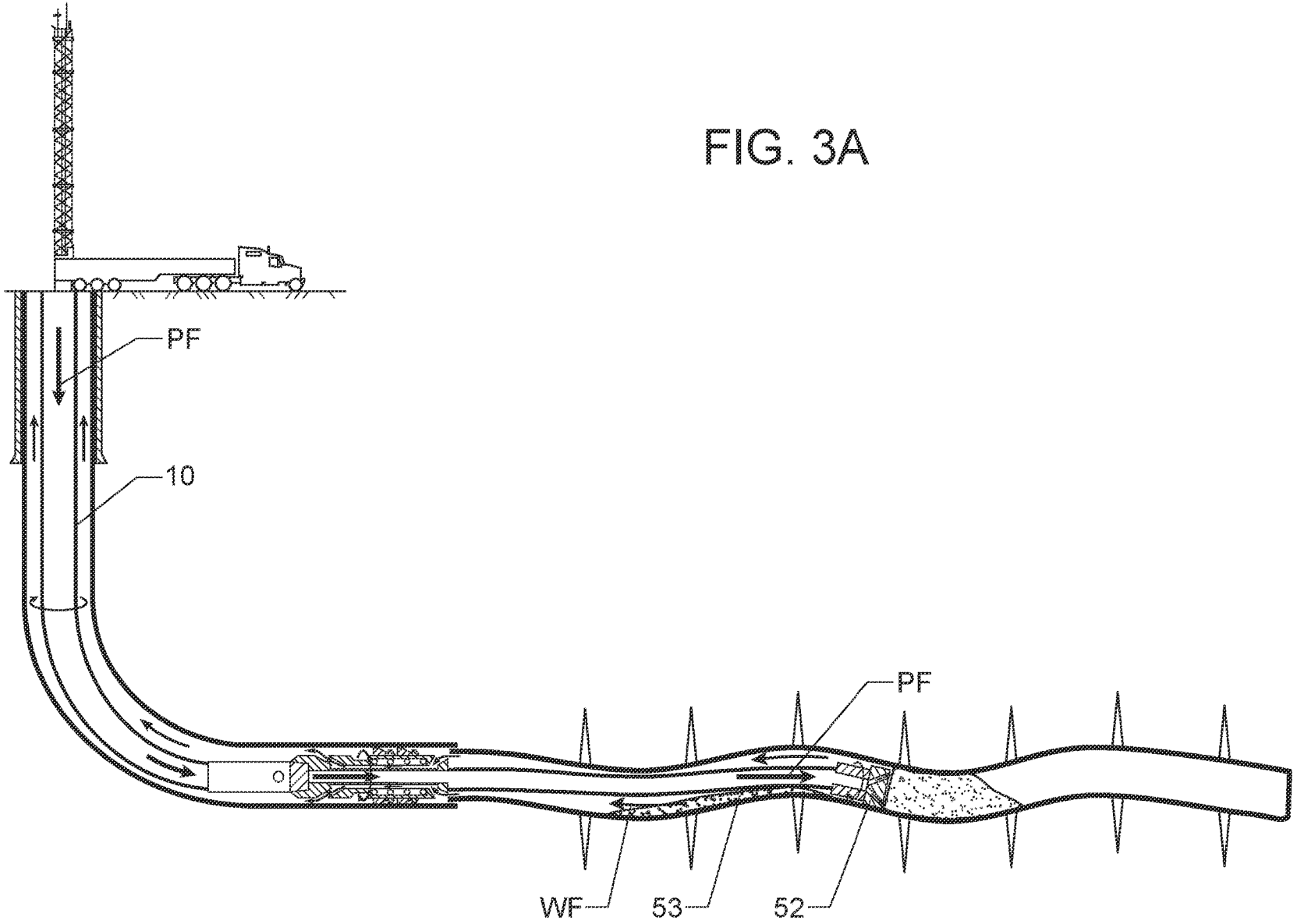
FIG. 3A depicts a schematic representation of the present system shown in FIG. 2, the system being configured to operate in a 'flushing mode of operation' with forward circulation down the tubing string annulus, according to embodiments.
Figure 3B:
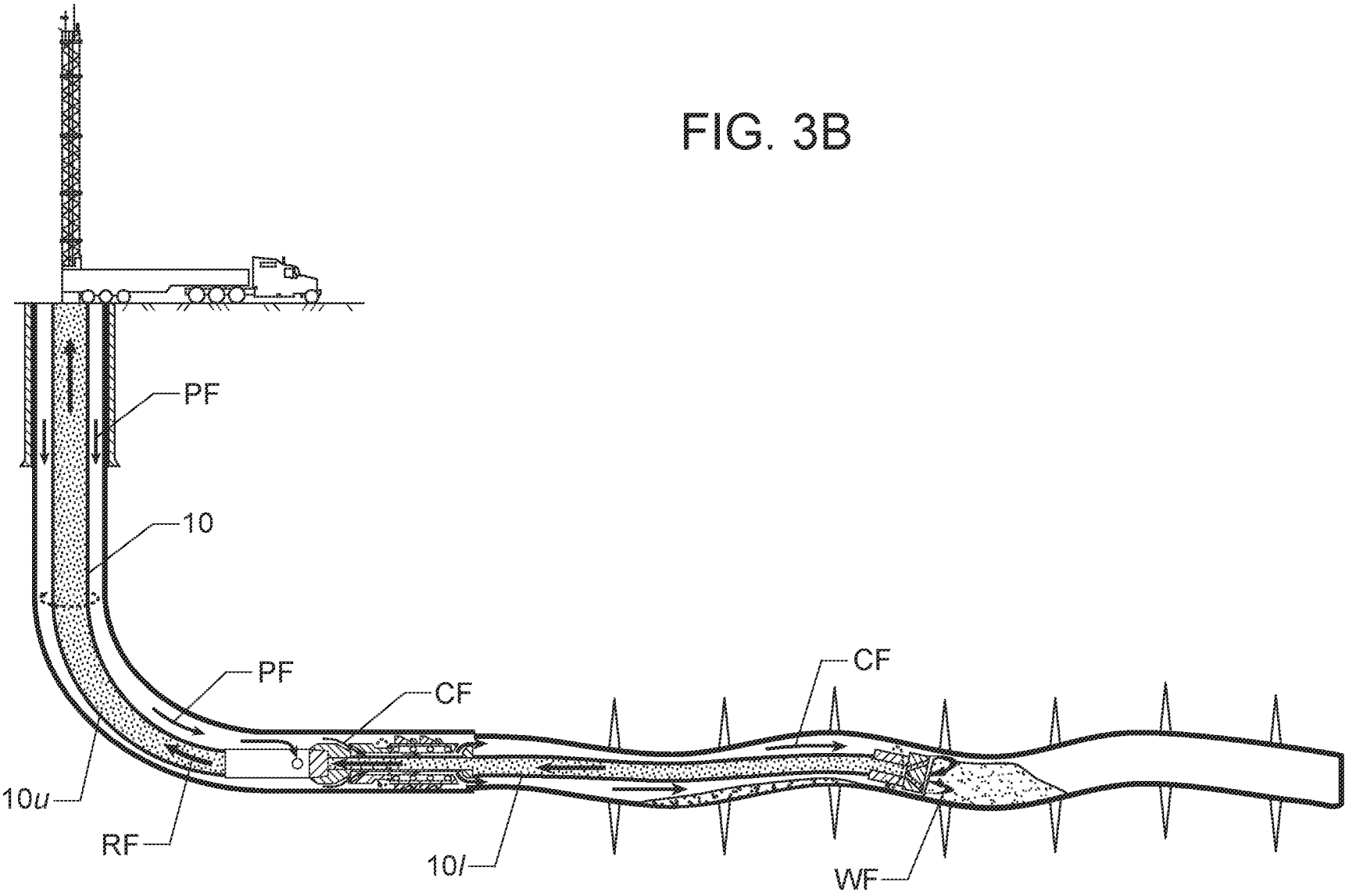
FIG. 3B depicts a schematic representation of the present system shown in FIG. 2, the system being configured to operate in a milling mode and/or cleanout mode of operation with reverse circulation of fluids pumping down the wellbore annulus, according to embodiments.

Milling and/or Cleaning Mode of Operation: Having regard to FIG. 3B, in a wellbore milling mode of operation, power fluids (arrows PF; FIG. 3B) may be injected into the annular space A of the wellbore W, the fluids will reach the system 100. Power fluids may comprise, preferably, water, brine, or any other appropriate fluids injected under pressure into the annular space A. Upon reaching the system 100, at least a first portion of the power fluids PF may form a 'power fluid stream' for operating the jet pump assembly 20, and at least a second portion of the fluids may form a 'cleaning fluid stream' being controllably diverted (e.g. jetted) downhole to clean the portion of the annular space A along the length of the system 100, before returning up through system 100 and tubing string 10 to the surface.

More specifically, at least a first portion of the injected fluids for operating the jet pump assembly 20 may form a 'power fluid stream' PF that enters the jet pump assembly 20, while at least a second portion of the injected fluids forms a 'cleaning fluid stream' (arrows CF; FIG. 3B) that is directed through the fluid flow bypass assembly 30 to clean the isolated section of the wellbore W therebelow. The bypassed cleaning fluid stream CF cleans the wellbore W by flushing or sweeping solids collecting in the annular space A downhole towards to the milling assembly 50. The cleaning fluid stream, along with the wellbore fluids and solids entrained therein (collectively referred to herein as the wellbore fluids WF; FIG. 3B), are then pumped or suctioned up into the tubing string 10 by the jet pump assembly 20. That is, jet pump assembly 20 draws wellbore fluids now containing at least the cleaning fluid stream CF and debris/solids entrained therein up into the tubing string 10, through system 100 to the surface.

During this mode of operation, the service rig S rotates work string 10 about its longitudinal axis, which in turn serves to rotate the present system 100, advancing the milling assembly 50 through obstruction(s) O blocking the wellbore W. Where desired, rotation of the present system 100 may be ceased, temporarily stopping the milling mode of operation, while the jet pump assembly 20 continues to suction debris from the wellbore W. To this end, depending upon whether or not the present system 100 is rotated, the milling mode of operation may comprise a milling and suctioning operation (e.g. pump assembly 20 suctions while milling assembly 50 is rotated), or a suctioning operation alone (e.g. solely operating pump assembly 20 to suction while milling assembly 50 is stationary). During this mode of operation, injected fluids are recovered at the surface as a return fluid stream RF via the tubing string 10 (as will be described in detail below).

Flushing Mode of Operation: In addition to the foregoing milling and/or cleaning modes of operation, advantageously, when it is desired to flush the wellbore W and/or it is required to reduce the hydrostatic fluid pressure in the wellbore W the present system 100 may also be operated in a cleanout or 'flushing mode of operation' (shown in FIG. 3A). In the flushing mode of operation, power fluids are injected into work string 10 and through the jet pump assembly 20 to wash the mill cuttings away from the area of milling, flushing the cuttings to form a mill cuttings bed within the annular space A of the wellbore W. During this mode of operation, injected fluids may be recovered at the surface via the annular space A of the wellbore W.

As above, according to embodiments, the present system 100 may be run into the wellbore W via a wellbore tool such as drilling assembly or a bottomhole assembly ('BHA'), the system 100 being positioned along and rotated with a suitable tubing string 10, which can be a conventionally threaded drill pipe. In some embodiments, tubing string 10 may comprise a workstring having an upper portion 10*u* extending uphole from system 100 and an elongate lower 'tailpipe' or 'stinger' portion 10*l* extending downhole from the system 100 (i.e. into the isolated section of the annular space A). For example, the lower portion of tubing string 10 may extend downhole until it lands at or near the obstruction(s) O being milled or cleaned from the wellbore W.

At its uphole end, the upper section of the tubing string 10*u* may be in fluid communication with the service rig S and, at its downhole end, be in fluid communication with jet pump assembly 20. The lower section of tubing string 10*l* may, at its uphole end, be in fluid communication with jet pump assembly 20 and, at its lower end, be in fluid communication with milling assembly 50.

In some embodiments, tubing string 10 may be formed in whole or in part by drill pipe, metal or composite coiled tubing, liner, casing, or other downhole componentry, and may comprise any form of appropriate attachments means for connecting the tubing string portions together and/or for connecting the tubing string to downhole componentry including, without limitation, threaded connections. It is further contemplated that the length of tubing string 10 may be increased or decreased in order to reposition the system 100 within the wellbore, optimizing cleaning and/or milling of obstruction(s) O from the wellbore W. In some embodiments, tubing string 10 may be further comprised of data and/or power transmission carriers, as applicable.

Figure 3C:
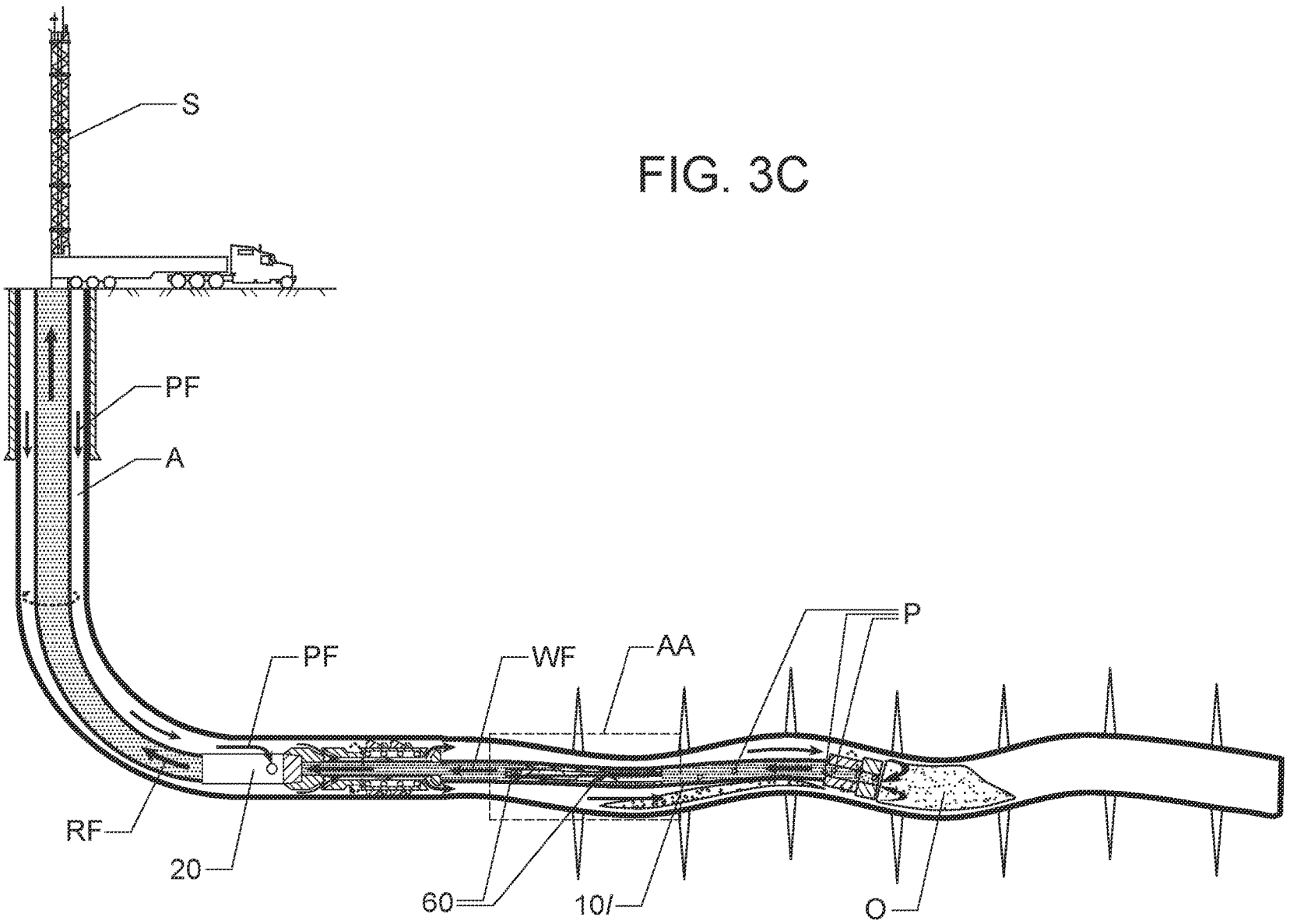
FIG. 3C depicts a schematic representation of the present system shown in FIG. 3B, the system further comprising an internal particulate screen, according to embodiments.
Figure 3D:
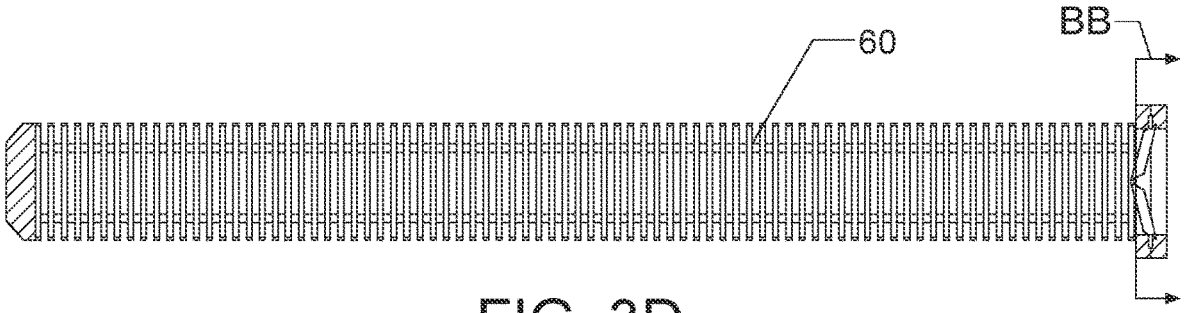
FIG. 3D depicts a zoomed in schematic view of at least one particulate screen (shown in box AA of FIG. 3C), according to embodiments.
Figure 3E:
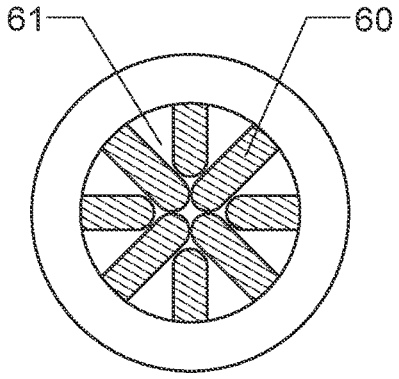
FIG. 3E depicts a cross-sectional side view (line BB in FIG. 3D) of the particulate screen, according to embodiments.

In some embodiments, having regard to FIGS. 3C, 3D and 3E, the lower portion of tubing string 10*l* may include at least one filter or screen 60 positioned in the tubing string 10*l* and within the wellbore fluid stream WF flowing uphole, the screen 60 serving to capture larger debris and/or milled particulates P within the wellbore fluids WF that are too large to pass through jet pump assembly 20. Screen 60 may provide one or more apertures or holes 61, such apertures being sized and shaped so as to accommodate trapping all anticipated large size cutting during operation, while still allowing free flow of fluids returning to the surface. In this manner, having regard to FIGS. 3D and 3E, screens 60 serve to restrict the flow of larger particulates P, while still allowing wellbore fluids WF to flow uphole to the assembly 20, thereby preventing the larger particulates P from entering and plugging-up the jet pump assembly 20. As would be understood, smaller particulates entrained in the wellbore fluids WF may pass through screen 60 to enter jet pump assembly 20, joining with power fluids PF therein to form the return fluid stream RF returning to the surface.

Depending upon the mode of operation, the upper portion of tubing string 10*u* may form a high-pressure fluid conduit for providing fluids injected at the surface to the milling assembly 50 (e.g. for flushing cuttings from the milling surface during flushing mode of operation) or, alternatively, the upper portion of tubing string 10*u* may form a return fluid string operative to receive wellbore fluids and debris entrained therein pumped from the wellbore W to the surface via jet pump assembly 20 (e.g. during the milling and/or cleanout modes of operation).

Depending upon the mode of operation, the lower 'tailpipe' portion of tubing string 10*l* may form a high-pressure fluid conduit for providing fluids injected at the surface to the milling assembly 50 (e.g. flushing mode of operation) or, alternatively, the lower 'tailpipe' portion of tubing string 10*l* may form a return fluid string operative to receive wellbore fluids WF and debris entrained therein pumped from the wellbore W to the surface via jet pump assembly 20 (e.g. milling and/or cleanout mode of operation).

Accordingly, advantageously, tubing string 10 enables a substantially unrestricted flow path for the fluids flowing to the milling assembly 50 and/or fluids returning sand and debris from the wellbore W to the surface, while overcoming any potentially negative impact of the relatively large flow area upon downhole fluid velocities and bottomhole pressures. That is, the tubing string 10, and specifically lower tailpipe portion, may be sized in order to optimize both annular velocity and internal tubing velocity in order to ensure optimal solids transport.

It should be understood that while the present embodiments describe the use of one tubing string 10, it is contemplated that an existing, installed, or additional wellbore workstring (not shown) may be utilized to provide one or more additional fluid paths from the surface to the system or vice versa. In some embodiments, the additional tubing string may be utilized to provide a cleaning fluid stream CF to the annular space A of the wellbore W below the system 100, such an additional tubing string eliminating the need for a fluid bypass assembly 30.

For example, one or more additional tubing strings may be positioned at or near the horizontal section H of the wellbore, and may have an open 'toe' end allowing for free fluid circulation down the annular space A of the wellbore W. In the milling mode of operation, a power fluid stream may be injected into the one or more additional tubing strings and down into the annular space A within the lower wellbore, wherein the advancing tubing tail may sweep any sand and debris towards the intake end of the lower 'tailpipe' tubing string 10*l* such that it can be drawn into the system 100 by the jet pump assembly 20.

According to embodiments, the present system 100 may comprise at least one pump assembly 20, the assembly consisting of one or more pumps configured for reverse flow to pump wellbore fluids WF to the surface. The at least one pump(s) may be any pump having an adjustable pump rate (e.g. bottomhole pressure and/or circulation rate may be controlled by the pump(s)), such as a jet pump.

Figure 4:
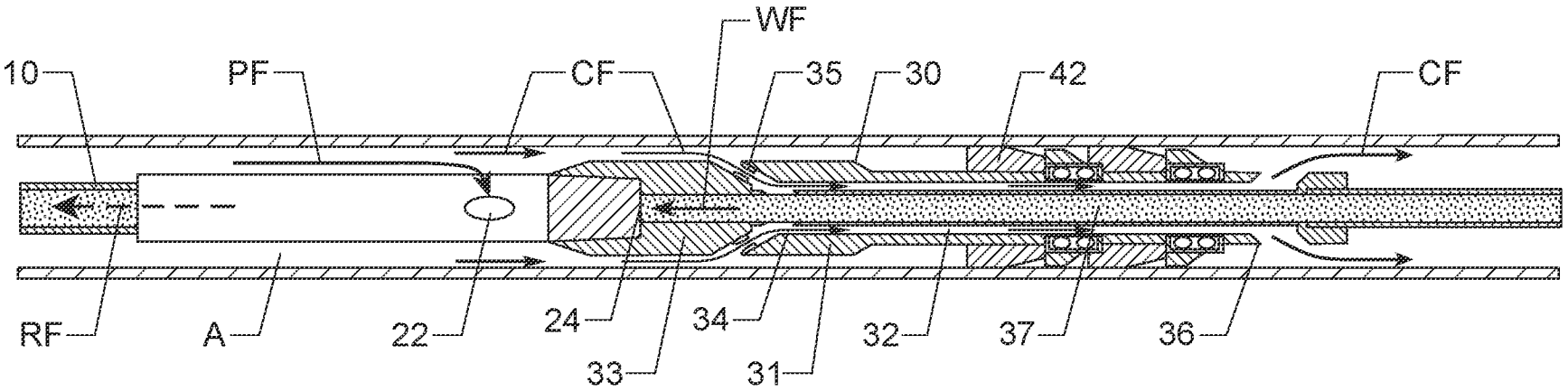
FIG. 4 depicts a zoomed in schematic view of the present system showing a jet pump assembly and a pressure isolation tool consisting of a fluid bypass assembly and a sealing assembly, according to embodiments.

Having regard to FIG. 4, in some embodiments, jet pump assembly 20 may comprise one or more power fluid ports 22 for admitting power fluid PF into the assembly 20. Fluids entering port 22 are directed towards a main internal nozzle(s) of the at least one pump(s) and then discharged into a throat area of the pump(s) and up to the surface via tubing string 10*u*. In some embodiments, the one or more power fluid ports 22 may be formed in or through the housing sidewall of pump assembly 20.

In some embodiments, at or near its downhole end, jet pump assembly 20 may further comprise at least one wellbore fluid ports 24 for receiving wellbore fluids WF, having debris and solids entrained therein, pumped up into the assembly 20. Wellbore fluids WF flowing under formation pressure into the assembly 20, via lower tubing string 10*l*, may be directed towards internal nozzle(s) such that wellbore fluids WF entering pump assembly 20 become mixed with power fluids PF before being returned to the surface (referred to collectively as return fluids RF). That is, fluids entering wellbore fluid port 24 are in fluid communication with fluids entering power fluid port 22, the collective fluids, combined with debris/solids, forming a 'return fluid stream' RF pumped through the system 100 to the surface.

In the milling mode of operation, where the pump assembly 20 operates in reverse circulation, at least a portion of power fluid stream PF injected under high pressure into the annular space A flows from the surface in the direction of the arrows PF (FIG. 4) through at least one power fluid port 22 into the jet pump assembly 20, out the uphole end of the pump assembly 20, and is returned to the surface. As the power fluid PF passes through the jet pump assembly 20, the velocity of the power fluid PF increases significantly, creating a jet stream. The jet pump assembly 20 thus acts like a venturi by taking the high-pressure power fluid PF (pumped from surface) and increasing the velocity of the power fluid as it passes out of the assembly 20 and back to the surface (via upper tubing string 10*l*). Without being limited by theory, the increased velocity of the fluids passing through the assembly 20 reduces the pressure in the power fluid PF stream, enabling the lower pressure fluid stream to create a suction or lift effect to drawn up at least a portion of the wellbore fluids and solids WF into the lower section of tubing string 10*l* to the surface where the fluids are expelled to surface tanks.

Where the pump assembly 20 operates in reverse circulation, the wellbore fluids WF are suctioned into the system 100, flowing in the direction of the arrows WF. Wellbore fluids WF are suctioned into the open, toe-end of tubing string 10*l* and into pump assembly 20, via wellbore fluid port 24. In the pump assembly 20, the wellbore fluids WF mix with the power fluid PF in the throat area of the one or more jet pump(s) to collectively form the return fluid stream (arrows RF). The pressure of the recovered or return fluids RF, comprised of power fluid PF, well fluids WF and solids, drives the return fluid stream RF out from a return fluid RF outlet in uphole end the pump assembly 20 and back to the surface, overcoming the hydrostatic head. During the milling mode of operation, the entire system 100 may be rotated by the rotation of the tubing string 10 from the surface at conventional milling speeds such that the milling assembly 50 may advance through any obstruction(s) O that may be blocking the wellbore W. As above, where it is desirable to operate the jet pump assembly 20 alone, rotation of the system 100 may be ceased temporarily, allowing suctioning of debris to continue without milling.

In the flushing mode of operation, the tubing string 10*u,l* and the pump assembly 20 are fluidically connected to form a fluid pathway for directing fluids injected at the surface to the milling assembly 50. The fluids are returned to surface via the annular space A.

According to embodiments, the present system 100 may further comprise at least one rotatable fluid bypass assembly 30. Broadly, the controlled fluid bypass assembly 30 may form a discrete fluid pathway extending through the assembly 30 (e.g. for transporting fluids from the isolated annular space A uphole of the assembly through the assembly to the annular space A therebelow, and vice versa). For example, during the milling mode of operation, at least a first portion of the pressurized fluids injected into the annular space A that become a 'power fluid stream' PF operate the jet pump assembly 20 as described above, while at least a second portion of the injected fluids instead enter the controlled fluid bypass assembly 30, becoming a 'cleaning fluid stream' CF jetted downhole for flushing sand and debris from the sealingly isolated portion of the wellbore W being cleaned below the system 100. As will be described, the cleaning fluid CF controllably exits bypass assembly 30 with sufficient velocity to stir up and entrain sand and debris in the annular space A of the wellbore W, effectively serving to flush or sweep out the wellbore W.

In some embodiments, having regard to FIG. 4, the controlled fluid bypass assembly 30 may comprise a tubular housing or sleeve 31 and mandrel 33, the sleeve 31 forming a central bore for concentrically receiving and encircling the mandrel 33. Mandrel 33 may also form a central bore in fluid communication with the jet pump assembly 20 thereabove, and the lower tubing string 10*l* therebelow. Sleeve 31 and mandrel may be operably connected, such as by threaded connection or other means known in the art. Mandrel 33 may be operably connected with jet pump assembly 20 and tubing string 10 for free rotation therewith. That is, at its upper end, mandrel 33 may be operably connected to the downhole end of jet pump assembly 20, such that the mandrel 33, sleeve 31 and tubing string 10 are configured to rotate freely.

In some embodiments, sleeve 31 may be specifically configured to form at least one annular fluid port or channel 32 in the annular space between the outer surface of the mandrel/tubing string 31,10 and the inner surface of sleeve 31. Each at least one flow control channel 32 may consist of an upper fluid port 34 which, during the milling mode of operation, receives pressurized fluids from the annulus A above system 100 (FIGS. 3B and 4) into channel 32, diverting the injected fluids downhole and, in contrast, during the flushing mode of operation, serves to direct fluids flowing uphole from channel 32 back into the annular space A above the system 100, where bottomhole pressures allow (FIG. 3A). Each at least one fluid control channel 32 may also consist of a lower fluid port 36 which, during the milling mode of operation, diverts fluids flowing through channel 32 out of the assembly 30 into the annulus A below system 100 (FIGS. 3B and 4) and, in contrast, during the flushing mode of operation, receives fluids from the annular space A below the system 100 into channel 32 for passage uphole. That is, power fluids PF injected under high pressure from the surface into the annular space A uphole of the system 100 pass through fluid port 34 (in the direction of arrows CF; FIG. 3B) downhole along channel 32 and back into the annular space A downhole of the system 100 through fluid port 36. In contrast, where desired, wellbore fluids WF returning to surface during the flushing mode of operation pass through fluid port 36 uphole along channel 32 and back into the annular space A above the system via fluid port 34.

Herein, fluid flow through the at least one fluid flow control channel 32 may be regulated. In some embodiments, each at least one fluid flow control channel 32 may be of any size or configuration, and may be specifically designed for regulating fluid flow bypassing pump assembly 30 into the annular space A therebelow (i.e. the annular space between the liner and tailpipe). In some embodiments, each at least one fluid flow control channel 32 may comprise flow-adjusting elements 35, such as a valve, choke, and/or nozzles, as known in the art, for controllably regulating or restricting the passage of fluids through channel 32, as desired. Flow-adjusting components may be positioned at or near upper fluid port 24, lower fluid port 36, or a combination thereof as would be known in the art.

Preferably, in some embodiments, it is contemplated that each at least one fluid channel 32 may be sized and shaped to cause cleaning fluids CF to enter the annular space A below pump assembly 20 at a rate so as to sweep any wellbore solids or cuttings within the annular space A towards the milling assembly 50, across the milling surface, and into the tubing string 10 due to the suction from the jet pump assembly 20 thereabove (as will be described in more detail below).

In some embodiments, fluid flow through the at least one fluid flow control channel 32 may be selectively opened and/or closed. In some embodiments, each at least one fluid channel 32 may further comprise a pressure-activated valve actuated by a specific pressure threshold for opening and closing channel 32. In other embodiments, the fluid bypass assembly 30 may comprise a switching tool allowing the operator to selectively open or close channel 32, as desired. For example, it is contemplated that such pressure-activated components may operate by cycling from an open to a closed positioned (and vice versa) when a specific pressure threshold is reached. When open, the at least one fluid control channel 32 operates as above. When closed, all of the power fluids PF injected into the wellbore W will pass solely through power fluid inlet port 22 of jet pump assembly 20.

Generally, the size and capacity of the bypass assembly 30 may be determined to suit the particular operating conditions and desired performance criteria, as well as to correspond to the planned operating pressure of the jet pump assembly 20. Without limitation, it should be appreciated that the at least one fluid control channel 32 may enable the bypass of fluids flowing from the annular space A above the system 100 to the space therebelow at a velocity that is sufficiently high to agitate and entrain all or most of the wellbore debris between the system 100 and the wellbore wall, to carry the debris to the downhole end of the tubing string 10, and to remove it from the wellbore in the return fluid stream RF. It should also be appreciated that the at least one fluid control channel 32 may enable the bypass of fluids flowing from the annular space A below the system 100 to the space thereabove at a velocity that is sufficient to return the fluids traveling uphole to the surface. For example, the size and shape of each at least one fluid channel 32 may be determined based upon the balancing of various factors including, without limitation, the size of the reservoir R, the size of the wellbore W, the size/capacity of the workstring 10 and pump assembly 20, bottom hole pressures and temperatures, the size of the debris being cleaned, and the transport velocity requirements, etc.

As would be appreciated by those skilled in the art, the fluid bypass assembly 30 may be machined or manufactured from materials selected to withstand the corrosive and abrasive wellbore environment. In some embodiments, the fluid bypass assembly 30 may be machined or manufactured from materials such as, without limitation, tungsten carbide, ceramics, diamond, or other suitable materials as would be known in the art. Any adaptation or modification of the present at least one fluid-controlled bypass assembly 30 may be used to achieve the desired result.

According to embodiments, the present system 100 may further comprise at least one sealing assembly 40, the sealing assembly 40 for releasably sealing the system 100 within the wellbore W and for isolating the annular space A below the system 100. Broadly, the at least one sealing assembly 40 may be deployed using a wireline or slick line, and may comprise one or more expandable components operative to isolate at least a horizontal section H of the wellbore W. As will be described in more detail, at its lower end, sealing assembly 40 may comprise a flow diverter sub 70 (FIG. 7 and FIGS. 8A-F) for providing alternative fluid flow through assembly 40.

Having regard to FIG. 5, the sealing assembly 40 may comprise at least one pressure isolation element, or seal(s) 42, for sealingly contacting and anchoring the present system 100 to the wall of the wellbore W, thereby preventing the flow of fluid through the annular space A and isolating the section of wellbore being cleaned out below the system 100. Various sealing devices are contemplated including friction cups, inflatable packers, compressible sealing elements, etc. In the particular embodiments illustrated herein, the at least one seal(s) 42 may comprise an annular seal, such as a cup-style pressure isolation seal, for encircling and securing the system 100 within the wellbore W. In other embodiments, the at least one seal 42 may comprise a compression packer style of seal for securing the system 100 within the wellbore W. Seals 42 may be composed of any non-metallic materials including composites, plastics, and elastomers. Any adaptation or modification of the present sealing assembly 40 may be used to achieve the desired result.

In some embodiments, the at least one seals 42 may be disposed about sleeve 31 between inlet and outlet ends 34,36 of fluid flow control channel 32, allowing fluids to flow through the fluid bypass assembly 30. At least one seal 42 may be provided, and preferably, a plurality of seals 42 may be provided such seals positioned in series about sleeve 31. In some embodiments, each of the at least one seals 42 may be operably integrated with at least one sealed bearing assembly 44 so as to enable high speed rotation of the sealing assembly 40 (i.e. the sleeve 31, mandrel 33 and tubing string 10) during the milling mode of operation, or as otherwise desired.

Figure 5:
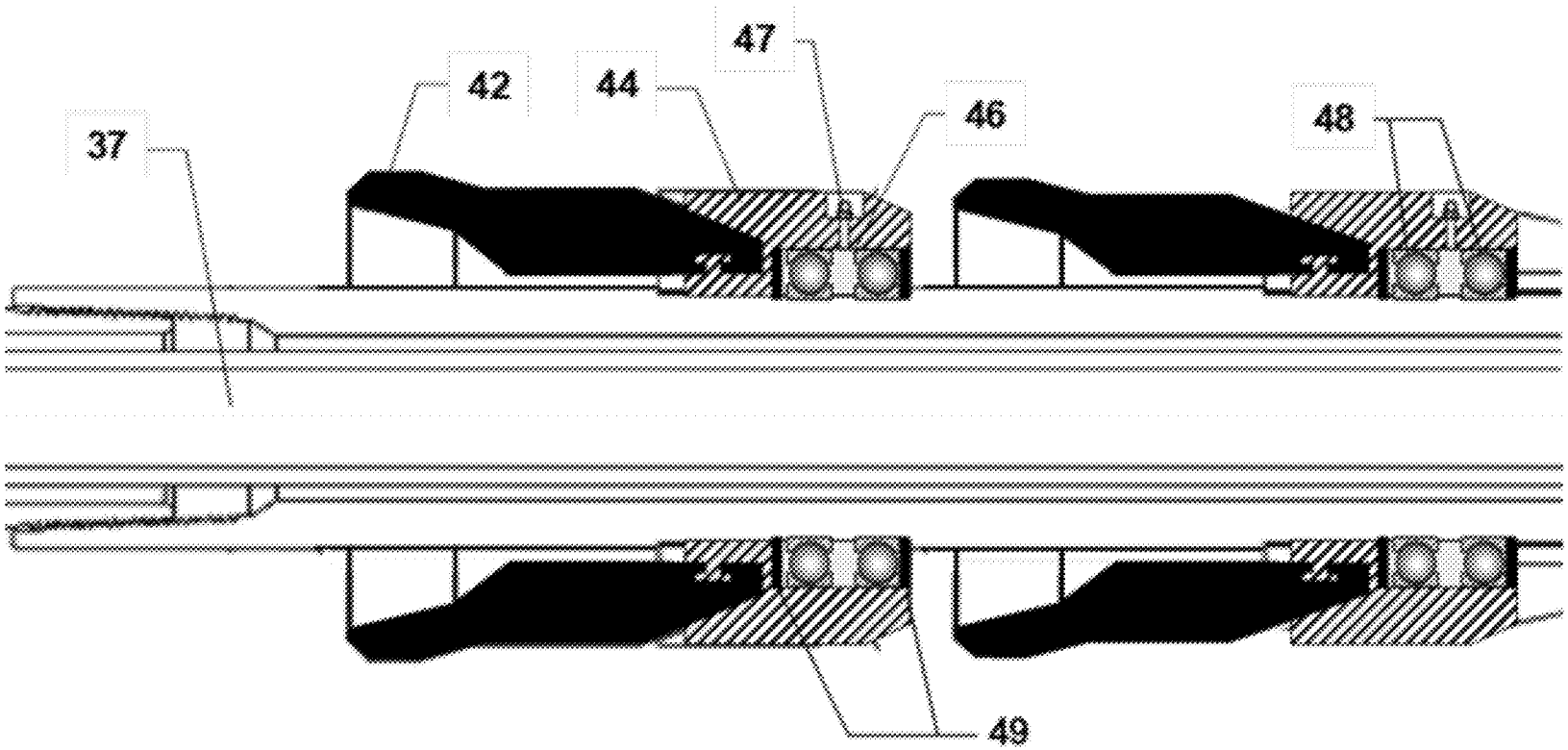
FIG. 5 depicts a zoomed in schematic view of a sealing assembly of the present system, according to embodiments.
Figure 6A:
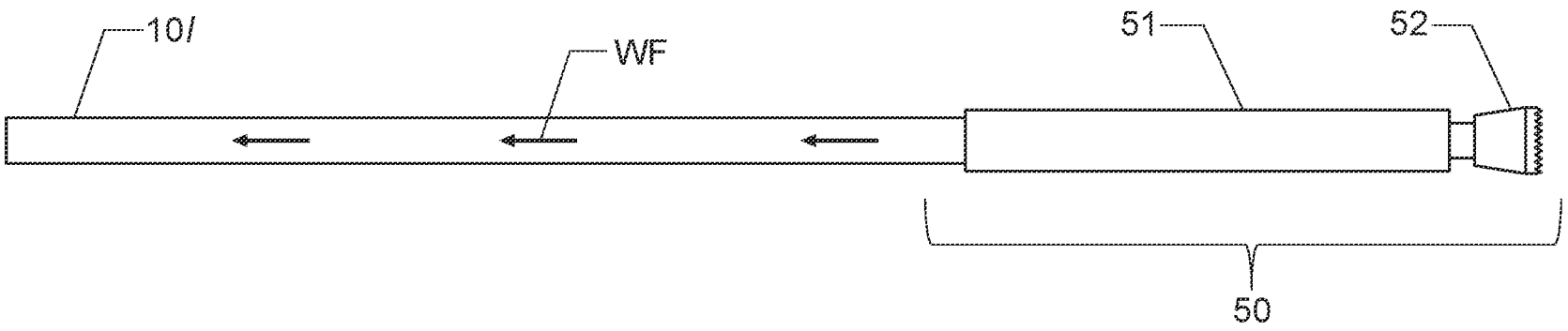
FIG. 6A depicts a zoomed in schematic view of the milling assembly, according to embodiments.
Figure 6B:
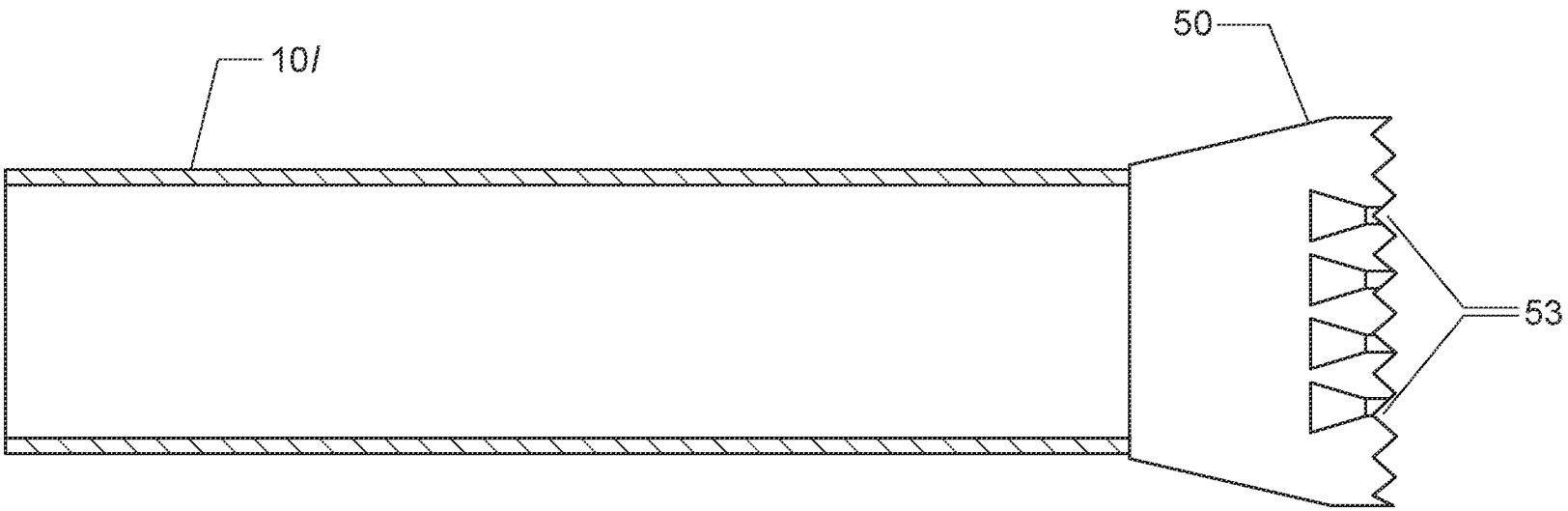
FIG. 6B depicts a zoomed in schematic view of the mill bit portion of the milling assembly, according to embodiments.

More specifically, having regard to FIG. 5, at its lower end, each at least one seal 42 may be positioned adjacent a bearing assembly 44, such that the bearing assembly 44 supports seals 42 while the main parts of the sealing assembly 40 rotates about its longitudinal axis within the wellbore W. That is, each at least one seal 42 remains stationary, supported by each at least one corresponding bearing assembly 44, maintaining a seal within the annular space A whether or not sealing assembly 40 is rotated relative thereto. In some embodiments, each at least one seal 42 may be operably connected with bearing assemblies 44 by a snap-fit connection, or any other appropriate connection known in the art, for securing seals 42 in place. For example, bearing assemblies 44 may be configured so as to serve as seal-retaining ring or backer.

Bearing assemblies 44 may comprise an assembly housing 46 having at least one seal 49 for sealingly receiving and housing at least one bearing 48 within housing 46. An outer surface of each bearing housing 46 may provide at least one lubricating fluid access port 47, for providing lubrication fluids to bearings 48. A downhole surface of the lowermost bearing assembly 44 forms a wellbore interface against wellbore fluids therebelow. Bearing elements may be selected from heavy duty bearings for rotationally and axially supporting loads resulting from wellbore pressure and tubular movement. Any adaptation or modification of the present sealing assembly 40 may be used to achieve the desired result.

MILLING ASSEMBLY: According to embodiments, having regard to FIGS. 6A and 6B, the present system 100 may further comprise at least one milling assembly 50. Generally, milling assembly 50 may comprise a well tool such as a drilling assembly or a bottom hole assembly disposed on the workstring 10 to provide rotational movement of the milling assembly 50, and operatively coupled to at least one motor 51. In operation, the milling assembly 50 may be set down on the milling and/or drilling target or obstruction(s) O for drilling or milling of the obstruction O, grinding it down or cutting into small transportable pieces/cuttings. The milled cuttings may be transported back uphole in the annular space A or, as would be appreciated by those skilled in the art, the cuttings may be harmlessly distributed along the bottom side of the wellbore W.

The motor 51 may be hydraulically actuated by fluids being pumped through the work string 10, and may comprise a positive displacement motor or other types of motors known in the art. Milling assembly 50 may be configured to have fluid intake ports 53 for receiving wellbore fluids WF suctioned into the system 100 during the milling and/or cleanout mode of operation, such ports alternatively serving as output ports for directing flushing fluids through the assembly 50 and into the wellbore during the flushing mode of operation.

In some embodiments, the milling assembly includes a drill bit 52 configured to disintegrate rock and earth. The bit 52 may be rotated (rotational arrow) by a surface rotary drive or a motor using pressurized power fluids PF (e.g. mud motor) or an electrically driven motor. In this regard, the milling assembly 50 may comprise a conventional positive displacement motor and bit 52, where the motor may be any other such downhole drilling motor, such as a turbine motor and where the bit 52 may be any mill-style of bit, such as a polycrystalline diamond (PDC) bit, a tricone bit, or any other useable drilling or milling bit type.

Figure 7:
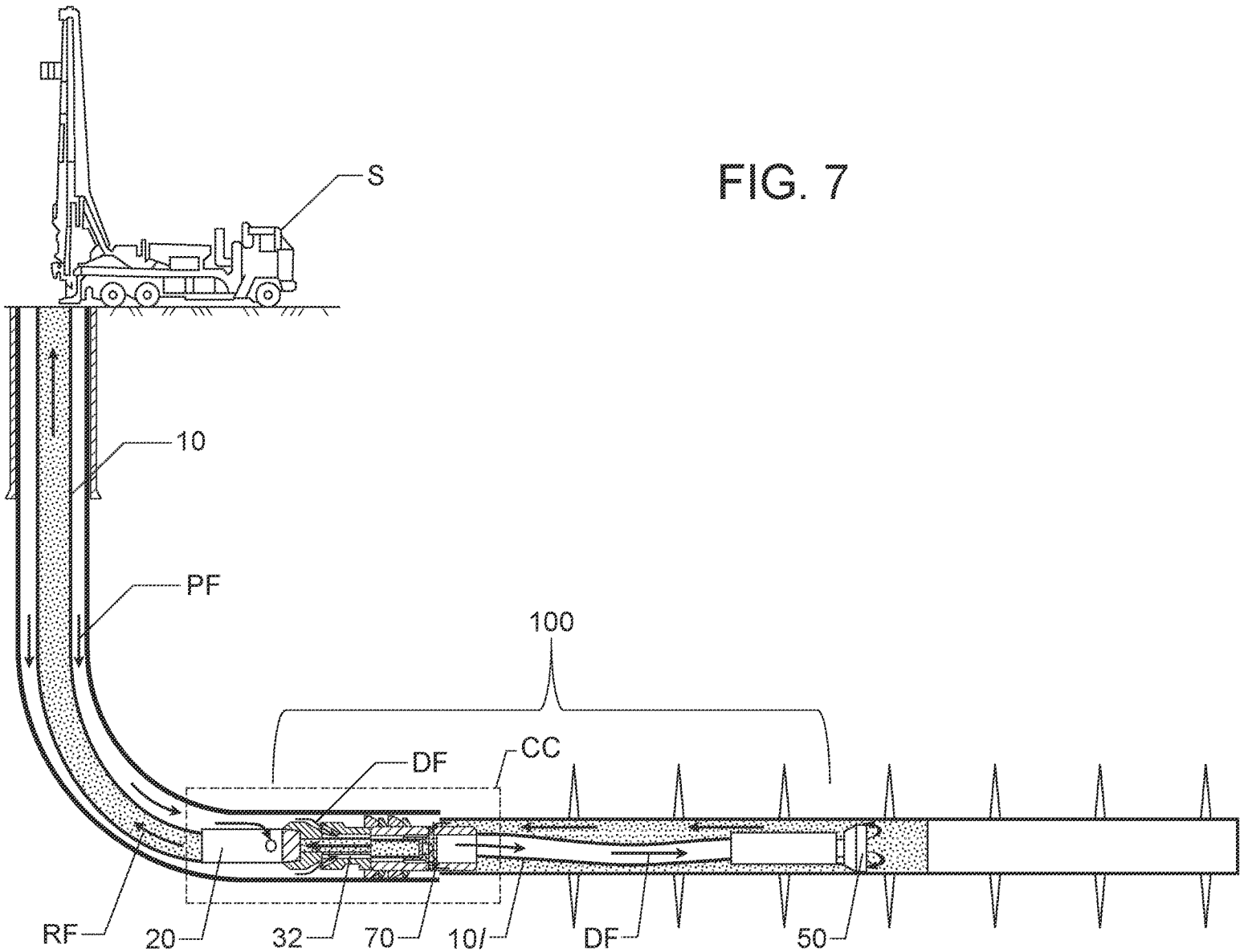
FIG. 7 depicts a schematic representation of an alternative embodiment of the present system deployed within the horizontal wellbore shown in FIG. 1, according to embodiments.
Figure 8:
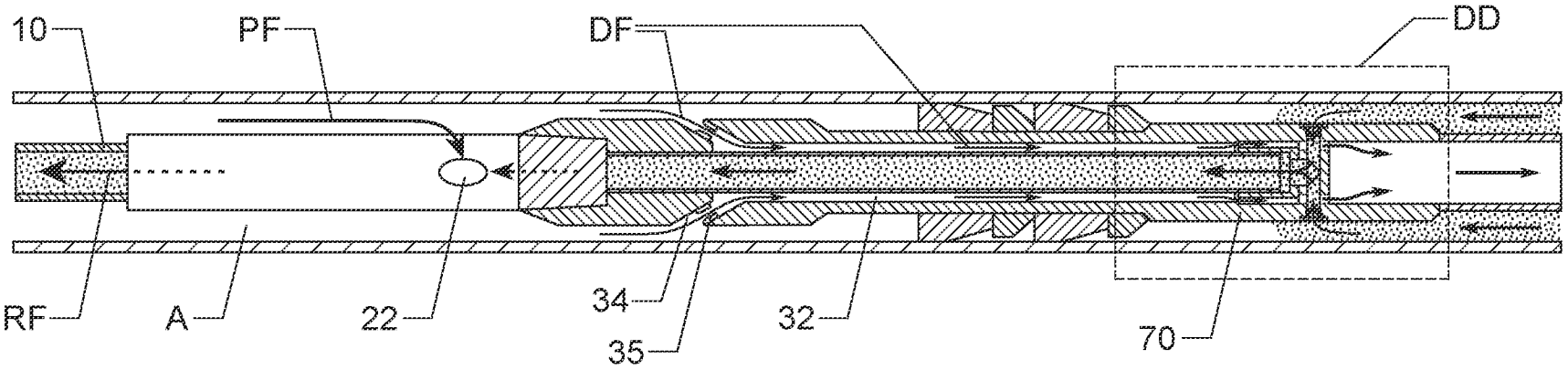
FIG. 8 depicts a zoomed in schematic view of the alternative embodiment of the present system showing a jet pump assembly and a pressure isolation tool consisting of a fluid bypass assembly, having a flow diverter sub, and a sealing assembly (box CC of FIG. 7), according to embodiments.
Figure 10:
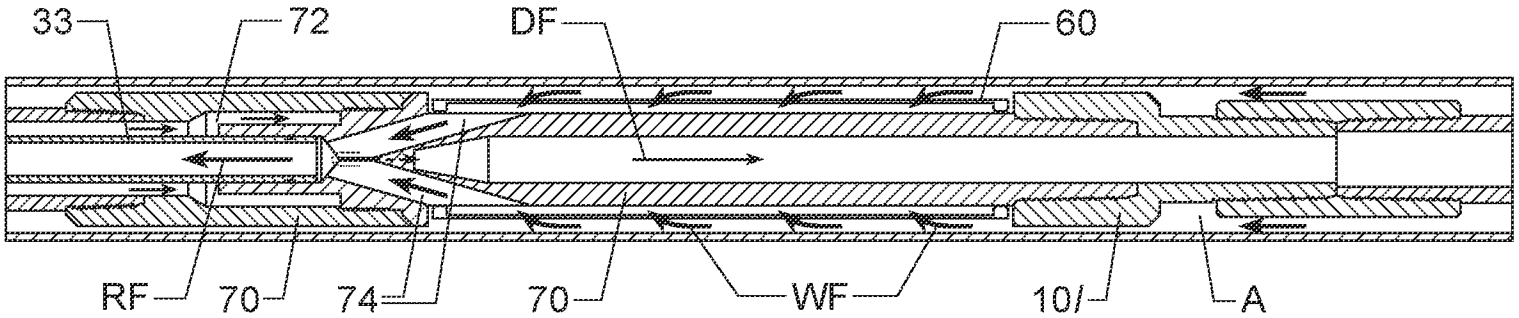
FIG. 10 depicts a schematic view of an alternative embodiment of a fluid diverter sub at the outlet end of the fluid bypass assembly of the pressure isolation tool, with directional arrows denoting fluid flow at the outlet end of the bypass assembly, according to embodiments.
Figure 11:
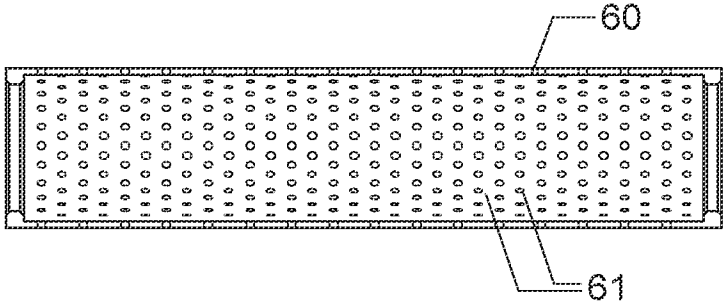
FIG. 11 depicts side view of a screen component shown encircling the alternative fluid bypass assembly shown in FIG. 10, the screen being shown in isolation for ease of reference.
Figure 12A:
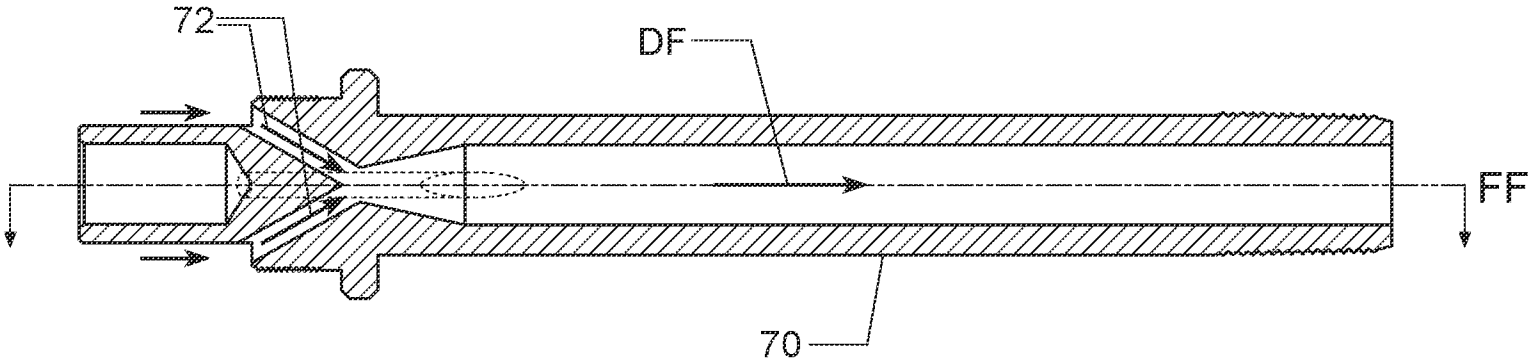
FIG. 12A depicts a schematic isolated view of the alternative fluid diverter sub shown in FIG. 10, according to embodiments.
Figure 12B:
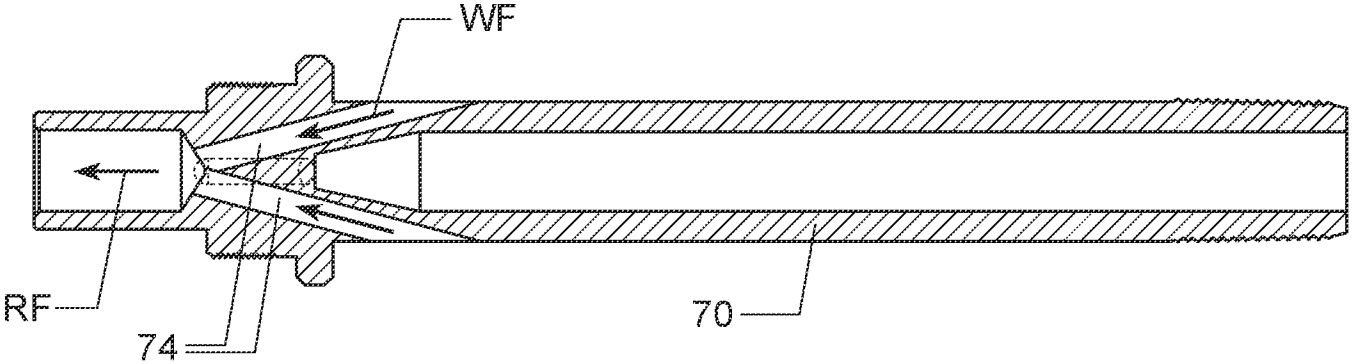
FIG. 12B depicts a cross sectional side view (lines FF in FIG. 12A) of the alternative fluid diverter sub, according to embodiments.

According to embodiments, the present system 100 may comprise at least one flow diverter sub 70, for providing alternative fluid flow through the system 100, and specifically through the downhole end of bypass assembly 30, during the milling and/or cleanout mode of operation. According to some embodiments, flow diverter sub 70 may be positioned at or near the downhole end of bypass assembly (FIGS. 7-9). According to other embodiments, flow diverter sub 70 may comprise an extension sub operably connected to the bypass assembly (FIGS. 10-12).

Broadly, as above, the system 100 may still initially be operably run in hole via tubing string 10, the tubing string being extended until the desired position within the annular space A of the wellbore W is reached. The pressure isolation tool may then be engaged to sealingly anchor the present system 100 within the annular space A of the wellbore W, effectively isolating a lower portion of the wellbore W below the system 100. As above, the present system 100 may comprise at least one jet pump assembly 20, a pressure isolation tool comprised of a fluid flow bypass assembly 30 and a sealing assembly 40, for sealingly engaging the system 100 within the annular space, and a milling assembly 50. As will be described, the fluid flow bypass assembly may comprise and/or be in fluid communication with a flow diverter sub 70, such flow diverter sub 70 operating to modify the fluid flow path at the downhole end of the bypass assembly 30.

Having regard to FIG. 8, a schematic representation of the present system 100 comprising a flow diverter sub 70 for providing an alternative, yet still discrete, fluid flow path 32 through bypass assembly 30 during the milling mode of operation. Pressurized fluids may still be injected into the annular space A of the wellbore W, the fluids reaching the system 100. Pressurized fluids may comprise water, brine, or any other appropriate fluids injected under pressure as known in the art. Upon reaching the system 100, at least a first portion of the injected fluids enter into jet pump assembly 20 forming a 'power fluid stream' PF, while at least a second portion of the injected fluids enter the fluid bypass assembly 30 forming a 'drive fluid stream' DF for driving the motor in the milling assembly 50 and exiting the bit 52 before flowing back up the annular space A and into system 100.

More specifically, the second portion of the injected fluids forming a 'drive fluid stream' DF may enter the fluid bypass assembly 30, via upper fluid port 34 into channel 32. Upon passing through channel 32, however, the second portion of the injected fluids pass into flow diverter sub 70 and into lower tubing string 10*l* until it reaches the milling assembly 50 to form a 'drive fluid stream' (DF; FIG. 8). That is, rather than exiting channel 32 via lower fluid port 36, the drive fluid stream DF instead passes through flow diverter sub 70 into the stinger 10*l* to the milling assembly 50, powering rotation thereof, as described below.

Figure 9A:
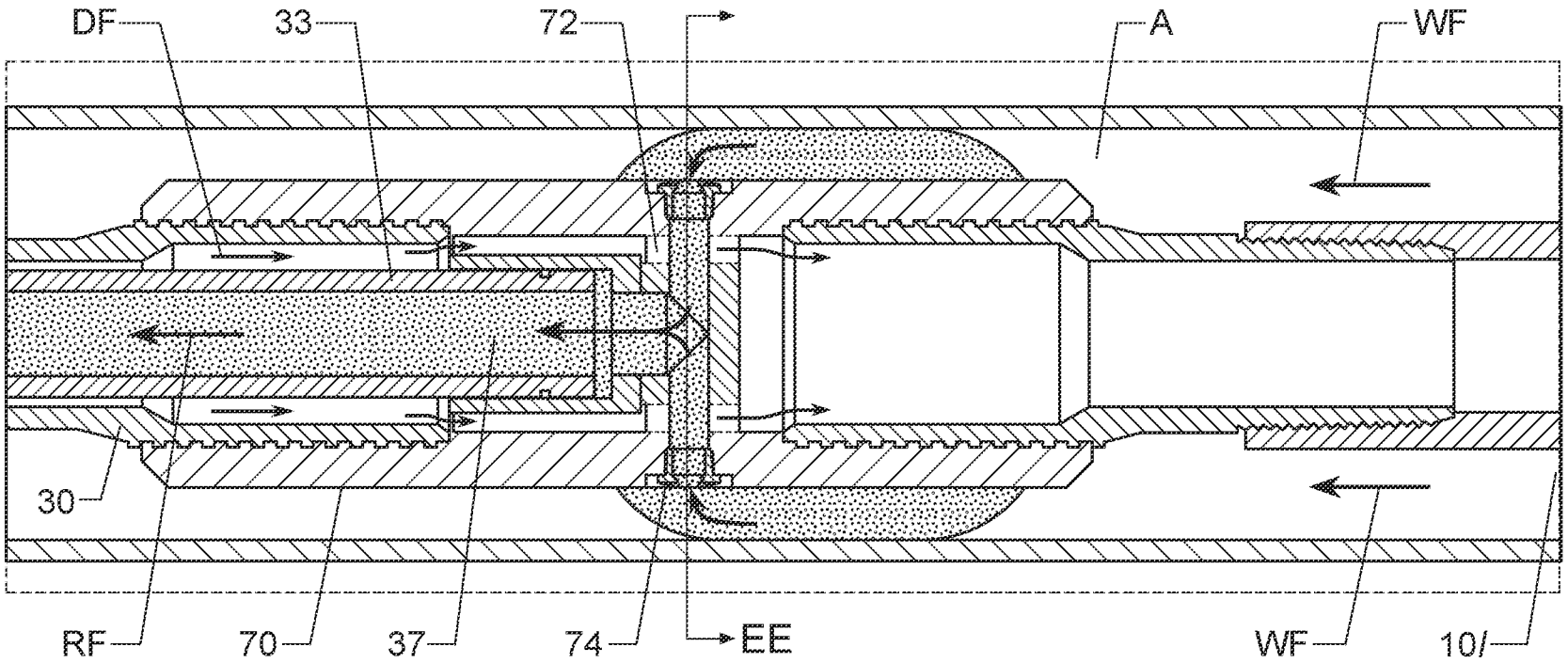
FIG. 9A depicts a further zoomed in schematic view of the outlet end of the fluid bypass assembly of the pressure isolation tool shown in FIG. 8 (box DD), with directional arrows denoting fluid flow at the outlet end of the bypass assembly, according to embodiments.
Figure 9B:
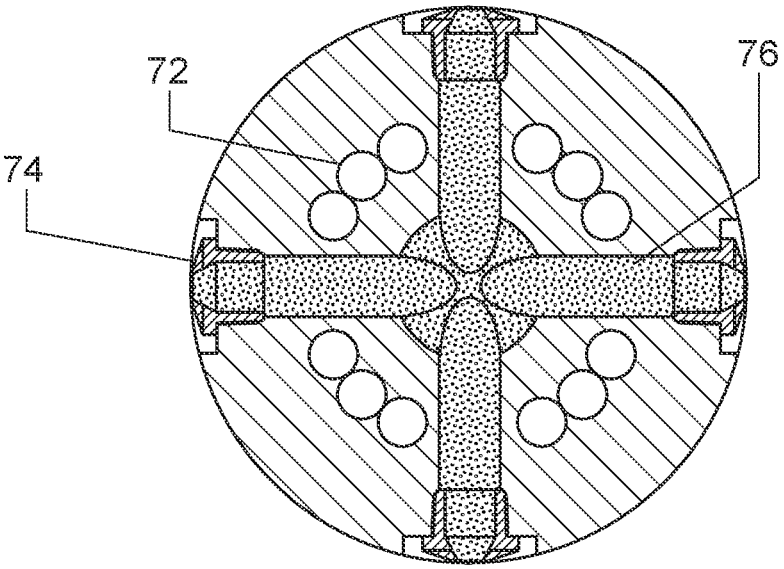
FIG. 9B depicts a schematic cross-sectional side view (lines EE in FIG. 9A) of the outlet end of the fluid bypass assembly of the pressure isolation tool, according to embodiments.

Having regard to FIG. 9A, at its upper end, flow diverter sub 70 may be operably connected to fluid bypass assembly 30 and, at its lower end, to lower tubing string 10*l*. Such connections between componentry may by threaded connection or other means known in the art, provided that the flow diverter sub 70 provides a fluid pathway between bypass assembly 30 and tubing string 10*l*. As such, drive fluid stream DF pass through channel 32 of flow bypass assembly 30 may pass through one or more fluid diverter ports 72 and into central bore of the stinger 10*l* until reaching the milling assembly 50, where the fluids power the rotation of the milling assembly 50, which in turn rotates the bit 52 to drill or mill the obstruction(s) O. Once milled, cuttings and debris entrained in wellbore fluids WF travel up the annular space A before passing back into flow diverter sub 70 via external flow ports 74, through transition channels 76 (FIG. 96), and into a discrete flow path formed within the central bore 37 of mandrel 33 of the bypass assembly 30. As above, the central bore 37 of mandrel 33 is in direct fluid communication with the wellbore fluid port 24 of the jet pump assembly 20 for passing wellbore fluids WF through assembly 20 and to the surface as return fluids RF. FIGS. 10, 11 and 12, provide a schematic representation of an alternative flow diverter sub 70, the sub 70 operative as described above. According to embodiments, having specific regard to FIG. 11, the flow diverter sub 70 may comprise one or more tubular filters or screens 60 for capturing and preventing larger particulates from entering external flow ports 74. As above, screen 60 may comprise a plurality of apertures 61 sized and shaped to accommodate trapping all anticipated large size cutting during operation.

In some embodiments, fluid flow through the at least one fluid flow diverter ports 72 and external flow ports 74 may be regulated. That is, the ports 72,74 may be of any size or configuration as determined and optimized by an integrated engineering approach, and may be specifically designed for regulating fluid flow passing through flow diverter sub 70 in order to ensure that fluid rates in at least each of the jet pump assembly 20, the fluid bypass assembly 30, and the milling assembly 50 are balanced and optimized. More specifically, in some embodiments, the size and fluid flow capacity of external ports 74 may be specifically determined based upon particle size limits for flow passage and rates through the remaining components of the system 100.

As above, in some embodiments, the milling assembly 50 and bit 52 may be set down on the milling and/or drilling target or obstruction, the obstruction being ground down or cut into small transportable pieces/cuttings. The milled cuttings may be transported back uphole in the annular space A (as will be described) or, as would be appreciated by those skilled in the art, the cuttings may be harmlessly distributed along the bottom side of the wellbore W.

Figure 14:
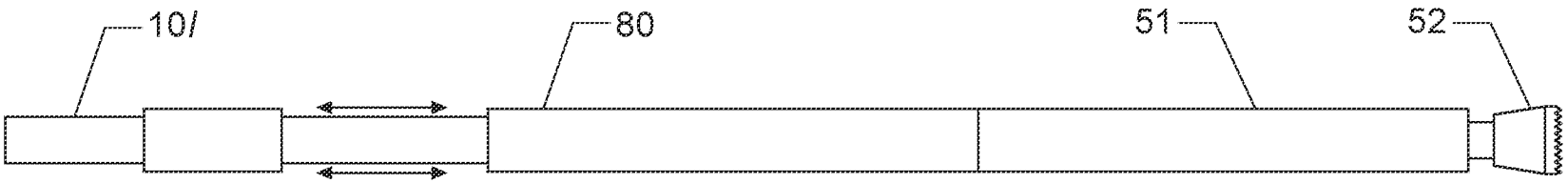
FIG. 14 depicts a schematic zoomed in view of the telescopic pressure sub shown in FIG. 13.

According to embodiments, having regard to FIGS. 13 and 14, the present system 100 may further comprise at least one telescopic pressure sub 80, allowing the milling assembly 50 and bit 52 to more accurately advance through the obstruction(s) O using differential pressure forces. In this regard, sub 80 may be telescopically coupled to and movable with milling assembly 50, where differential fluid pressures within sub 80 may be used to controllably actuate the sub 80 to position and re-position milling assembly 50. That is, advancement of the milling assembly 50 towards obstruction(s) O may either be assisted by, or achieved with, the at least one telescopic pressure sub 80.

Broadly having regard to FIGS. 1-14, an improved wellbore milling system 100 and methods of use for both milling obstructions O plugging a wellbore W and for evacuating debris and the milled obstructions O from the wellbore W is provided, whether simultaneously or independently. Where desired, the present system may efficiently be flushed through, removing cuttings from the milling assembly, without the need to move or reposition the system.

The present system benefits from the entire system 100 being movably positioned within the wellbore W. Preferably, the entire system 100 may be positioned at or as close to the area being cleaned or to the obstruction(s) O blocking the wellbore W, enabling ideal positioning of the 'tailpipe' tubing string 10 extending from the system 100 into the horizontal section H of the wellbore W. Positioning of the system 100 enables fluid velocities of the cleaning fluids CF to be sufficient to lift and carry sand and debris along the horizontal wellbore to the downhole end of the string 10, and to operatively mill through obstructions O blocking the wellbore W while advantageously maintaining a balanced, near-balanced, or underbalanced condition therein.

More specifically, an improved wellbore milling system 100 and methods of use for both milling obstruction(s) O plugging a wellbore W and evacuating debris and the milled obstruction(s) O from the wellbore are provided, whereby the system may further filter larger particulates in the wellbore fluids WF, preventing larger particulates from entering and plugging the system 100. The system may further comprise a flow diverter sub for providing alternative, discrete fluid flow paths through the system. Finally, the system may further comprise at least one telescopic pressure sub 80 for ensuring that the entire obstruction(s) O being targeted can be milled through completely without the need to move or reposition the system 100 within the wellbore W.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and the described portions thereof. It is intended that the following claims be construed to include alternative embodiments to the extent permitted by the prior art.

The invention claimed is:

1. A system for milling and cleaning an obstruction from a wellbore, the system comprising:

at least one tubing string for deploying the system within the annular space of the wellbore, the tubing string rotatable about its longitudinal axis and having a first uphole section extending uphole from the system, a second downhole section extending downhole from the system, and having a central tubing string bore forming a fluid pathway;

at least one pump assembly, operatively rotatably connected to the tubing string and in fluid communication therewith, for receiving at least a first portion of a fluid stream injected from the surface into the annular space of the wellbore, such first portion of the injected fluids forming a power fluid stream for driving the at least one pump assembly to pump milled obstruction debris and wellbore fluids from the annular space of the wellbore into the system and to the surface as return fluids;

at least one fluid bypass assembly, rotatably connected to the at least one pump assembly, the at least one fluid bypass assembly having:

at least one mandrel, the at least one mandrel having a fluid inlet end and a fluid outlet end and forming a central mandrel bore forming a first fluid passageway in communication with the at least one pump assembly and the at least one tubing string bore, the central mandrel bore in communication with the wellbore downhole of the system for receiving the wellbore fluids and returning the wellbore fluids to the surface as return fluids;

at least one sleeve, the at least one sleeve having a fluid inlet end and a fluid outlet end and forming a central sleeve bore for concentrically receiving the at least one mandrel and forming at least one fluid flow control channel for receiving a second portion of the fluid stream injected from the surface into the wellbore and diverting the second portion of the fluid stream into the wellbore downhole of the system, to form a cleaning fluid stream;

at least one sealing assembly for sealingly positioning the system within the wellbore, the at least one sealing assembly having:

at least one annular seal disposed about the at least one fluid bypass assembly between the fluid inlet end and the fluid outlet end, and at least one bearing assembly operatively connected to the at least one annular seal, the at least one bearing assembly having at least one bearing sealingly housed within an assembly housing, and configured to allow rotation of the at least one fluid bypass assembly; and at least one milling assembly, the at least one milling assembly operatively rotatably connected to and in fluid communication with the tubing string, the fluid bypass assembly, and the pump assembly, for milling the obstruction, wherein, when the system is rotated, the at least one milling assembly is configured to mill the obstruction from the wellbore and the at least one pump assembly is configured to simultaneously clean the obstruction from the wellbore.

2. The system of claim 1, wherein the at least one pump assembly comprises at least one jet pump configured for reverse circulation fluid flow.

3. The system of claim 1, wherein the at least one pump assembly comprises at least one power fluid port for receiving the power fluid stream from the wellbore uphole of the system.

4. The system of claim 1, wherein the at least one pump assembly comprises at least one wellbore fluid port for receiving the wellbore fluids from the wellbore downhole of the system.

5. The system of claim 1, wherein the at least one pump assembly comprises an uphole outlet port for directing the power fluid stream and the wellbore fluid stream to the surface as a return fluid stream.

6. The system of claim 1, wherein the discrete fluid pathway is formed between an inner surface of the sleeve and an outer surface of the mandrel.

7. The system of claim 1, wherein the discrete fluid pathway comprises one or more flow-adjusting elements for regulating fluid flow through the pathway.

8. The system of claim 1, wherein the fluid bypass assembly further comprises one or more valves for controllably opening and closing the discrete fluid pathway.

9. The system of claim 1 wherein the system further comprises at least one flow diverter sub.

10. The system of claim 1, wherein the system further comprises a telescopic pressure sub operably connected to the milling assembly.

11. The system of claim 1, wherein the central bore of the tubing string further comprises a screen for filtering larger particulates from the wellbore fluids.

12. A method of milling an obstruction from a wellbore using a system sealingly positioned within the wellbore, the method comprising:

deploying the system within the wellbore, the system deployed with and operably connected to a tubing string, the tubing string being rotatable about its longitudinal axis, the system having at least one sealing assembly for sealingly positioning the system within the wellbore, the at least one sealing assembly having at least one annular seal and at least one bearing assembly operatively connected to the at least one annular seal, the at least one bearing assembly having at least one bearing sealingly housed within an assembly housing, and configured to allow rotation of the system while sealingly positioned within the wellbore, and at least one fluid bypass assembly, rotatably positioned within the sealing assembly, the at least one fluid bypass assembly having:

at least one mandrel, at least one sleeve, the at least one sleeve having at least one fluid inlet end and at least on fluid outlet end and forming at least one fluid control channel between the mandrel and the sleeve; and injecting a fluid stream from the surface into the wellbore uphole of the system, and diverting at least a first portion of the injected fluid stream entering the system as a power fluid stream to drive at least one pump assembly for pumping milled obstruction debris from the wellbore into the system, and diverting at least a second portion of the injected fluid stream through the at least one fluid control channel as a cleaning fluid stream to the wellbore below the system, and rotating the system to drive at least one milling assembly, rotatably connected to the tubing string, for milling the obstruction within the wellbore, to simultaneously mill the obstruction, clean the wellbore, and pump milled obstruction debris from the wellbore into the system and to the surface.

13. The method of claim 12, wherein the method comprises ceasing rotation of the system to only pump milled obstruction debris from the wellbore into the system.

14. The method of claim 12, wherein the method comprises ceasing rotation of the system and injecting a fluid stream from the surface into the tubing string to flush milled obstruction debris from the milling assembly.

15. The method of claim 12, wherein the method comprises operating the at least one pump assembly in reverse circulation fluid flow.

16. The method of claim 12, wherein the method comprises diverting the cleaning fluid stream into the wellbore below the system with sufficient velocity to agitate and entrain debris within the cleaning fluid stream.

17. The method of claim 12, wherein the cleaning fluid stream is diverted through one or more flow-adjusting elements for controlling fluid velocity.

18. The method of claim 12, wherein the method comprises providing at least one valve for controllably opening and closing the discrete flow path.

19. A system for milling and cleaning an obstruction from a wellbore, the system comprising:

at least one tubing string for deploying the system within the wellbore, the tubing string rotatable about its longitudinal axis and having a first uphole section extending uphole from the system, a second downhole section extending downhole from the system, and having a central bore forming a fluid pathway, at least one sealing assembly for sealingly positioning the system within the wellbore, the at least one sealing assembly having:

at least one annular seal and at least one bearing assembly operatively connected to the at least one annular seal, the at least one bearing assembly having at least one bearing sealingly housed within an assembly housing, and configured for rotation of the system while sealingly positioned within the wellbore;

at least one pump assembly, operatively connected to the tubing string and in fluid communication therewith, for receiving at least a first portion of a fluid stream injected from the surface into the wellbore, such first portion of the injected fluids forming a power fluid stream for driving the at least one pump assembly to pump milled obstruction debris and wellbore fluids from the wellbore into the system and to the surface as return fluids;

at least one fluid bypass assembly forming a discrete fluid pathway through the system, for receiving at least a second portion of the fluid stream injected from the surface into the wellbore and diverting said second portion of the fluid stream through the discrete fluid pathway into the wellbore downhole of the system, such second portion of the injected fluids forming a cleaning fluid stream; and at least one milling assembly, operatively connected to the tubing string and in fluid communication therewith, for milling the obstruction when the system is rotated;

wherein the system further comprises a telescopic pressure sub operably connected to the milling assembly.

* * * * *